US009233298B2

(12) United States Patent
Sines

(10) Patent No.: US 9,233,298 B2
(45) **Date of Patent: *Jan. 12, 2016**

(54) PLAYING CARD SHUFFLER

(71) Applicant: Bally Gaming, Inc., Las Vegas, NV (US)

(72) Inventor: Randy D. Sines, Spokane, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/275,719

(22) Filed: May 12, 2014

(65) Prior Publication Data

US 2014/0246830 A1 Sep. 4, 2014

Related U.S. Application Data

(63) Continuation of application No. 13/925,249, filed on Jun. 24, 2013, now Pat. No. 8,720,892, which is a continuation of application No. 13/101,717, filed on May 5, 2011, now Pat. No. 8,469,360, which is a continuation of application No. 12/384,732, filed on Apr. 7, 2009, now Pat. No. 7,988,152.

(51) Int. Cl.
*A63F 1/12* (2006.01)

(52) U.S. Cl.
CPC ..... *A63F 1/12* (2013.01)

(58) Field of Classification Search
CPC ..... A63F 1/12
USPC ..... 273/149 R, 149 P
See application file for complete search history.

(56) References Cited

U.S. PATENT DOCUMENTS

| | | | | |
|---|---|---|---|---|
| 130,281 A | | 8/1872 | Coughlik | |
| 205,030 A | | 6/1878 | Ash | |
| 414,014 A | * | 10/1889 | Wakeford | 119/410 |
| 609,730 A | | 8/1898 | Booth | |

(Continued)

FOREIGN PATENT DOCUMENTS

| | | |
|---|---|---|
| AU | 5025479 A | 3/1980 |
| AU | 757636 B2 | 2/2003 |

(Continued)

OTHER PUBLICATIONS

PCT International Search Report and Written Opinion of the International Searching Authority for PCT/US2010/001032, dated Jun. 16, 2010, 11 pages.

(Continued)

*Primary Examiner* — Benjamin Layno
(74) *Attorney, Agent, or Firm* — TraskBritt

(57) ABSTRACT

An apparatus is for shuffling a plurality of playing cards used in gaming. The apparatus includes a card support adapted to support the unshuffled cards on-edge. An exciter is also included, and is adapted to impart vibrational action to the supported cards. Cards drop in a random fashion such as by controlling the relative position of the cards and passage through one or more card slots in a card rest. In at least some of the apparatuses, a medial card receiver is adapted to receive at least one card dropped from the card support and to retain the at least one received card to substantially block the card slot to prevent further cards from dropping. A positioner is preferably included to change a relative position of the unshuffled deck and card slots though which the cards drop.

20 Claims, 11 Drawing Sheets

(56) References Cited

U.S. PATENT DOCUMENTS

| | | | |
|---|---|---|---|
| 673,154 | A | 4/1901 | Bellows |
| 793,489 | A | 6/1905 | Williams |
| 892,389 | A | 7/1908 | Bellows |
| 1,014,219 | A | 1/1912 | Hall |
| 1,043,109 | A | 11/1912 | Hurm |
| 1,157,898 | A | 10/1915 | Perret |
| 1,556,856 | A | 10/1925 | Lipps |
| 1,850,114 | A | 3/1932 | McCaddin |
| 1,885,276 | A | 11/1932 | McKay |
| 1,955,926 | A | 4/1934 | Matthaey |
| 1,992,085 | A | 2/1935 | McKay |
| 1,998,690 | A | 4/1935 | Shepherd et al. |
| 2,001,220 | A | 5/1935 | Smith |
| 2,001,918 | A | 5/1935 | Nevius |
| 2,016,030 | A | 10/1935 | Rose |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,328,153 | A | 8/1943 | Laing |
| 2,328,879 | A | 9/1943 | Isaacson |
| 2,364,413 | A | 12/1944 | Wittel |
| 2,525,305 | A | 10/1950 | Lombard |
| 2,543,522 | A | 2/1951 | Cohen |
| 2,588,582 | A | 3/1952 | Sivertson |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Morgan Earl et al. |
| 2,714,510 | A | 8/1955 | Oppenlander et al. |
| 2,717,782 | A | 9/1955 | Droll |
| 2,727,747 | A | 12/1955 | Semisch |
| 2,731,271 | A | 1/1956 | Brown |
| 2,747,877 | A | 5/1956 | Howard |
| 2,755,090 | A | 7/1956 | Aldrich |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,757,005 | A | 7/1959 | Nothaft |
| 2,760,779 | A | 8/1959 | Ogden et al. |
| 2,914,215 | A | 11/1959 | Neidig |
| 2,937,739 | A | 5/1960 | Moise |
| 2,950,005 | A | 8/1960 | MacDonald |
| RE24,986 | E | 5/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Gronneberg |
| 3,147,978 | A | 9/1964 | Sjostrand |
| 3,222,071 | A | 12/1965 | Lang |
| 3,235,741 | A | 2/1966 | Plaisance |
| 3,288,308 | A | 11/1966 | Ginger |
| 3,305,237 | A | 2/1967 | Granius |
| 3,312,473 | A | 4/1967 | Friedman et al. |
| 3,452,509 | A | 7/1969 | Hauer |
| 3,530,968 | A | 9/1970 | Palmer |
| 3,588,116 | A | 6/1971 | Miura |
| 3,589,730 | A | 6/1971 | Slay |
| 3,595,388 | A | 7/1971 | Castaldi |
| 3,597,076 | A | 8/1971 | Hubbard |
| 3,618,933 | A | 11/1971 | Roggenstein |
| 3,627,331 | A | 12/1971 | Lyon, Jr. |
| 3,666,270 | A | 5/1972 | Mazur |
| 3,680,853 | A | 8/1972 | Houghton |
| 3,690,670 | A | 9/1972 | Cassidy et al. |
| 3,704,938 | A | 12/1972 | Fanselow |
| 3,716,238 | A | 2/1973 | Forter |
| 3,751,041 | A | 8/1973 | Seifert |
| 3,761,079 | A | 9/1973 | Azure |
| 3,810,627 | A | 5/1974 | Levy |
| 3,861,261 | A | 1/1975 | Maxey |
| 3,897,954 | A | 8/1975 | Erickson et al. |
| 3,909,002 | A | 9/1975 | Levy |
| 3,929,339 | A | 12/1975 | Mattioli |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Noguchi et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette |
| 4,339,134 | A | 7/1982 | Macheel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Suda et al. |
| 4,397,469 | A | 8/1983 | Carter |
| 4,421,312 | A | 12/1983 | Delgado et al. |
| 4,421,501 | A | 12/1983 | Scheffer |
| D274,069 | S | 5/1984 | Fromm |
| 4,467,424 | A | 8/1984 | Hedges et al. |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel |
| 4,515,367 | A | 5/1985 | Howard |
| 4,531,187 | A | 7/1985 | Uhland |
| 4,534,562 | A | 8/1985 | Cuff et al. |
| 4,549,738 | A | 10/1985 | Greitzer |
| 4,566,782 | A | 1/1986 | Britt et al. |
| 4,575,367 | A | 3/1986 | Karmel |
| 4,586,712 | A | 5/1986 | Lorber et al. |
| 4,659,082 | A | 4/1987 | Greenberg |
| 4,662,637 | A | 5/1987 | Pfeiffer et al. |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak |
| 4,858,000 | A | 8/1989 | Lu |
| 4,861,041 | A | 8/1989 | Jones et al. |
| 4,876,000 | A | 10/1989 | Mikhail |
| 4,900,009 | A | 2/1990 | Kitahara et al. |
| 4,904,830 | A | 2/1990 | Rizzuto |
| 4,921,109 | A | 5/1990 | Hasuo et al. |
| 4,926,327 | A | 5/1990 | Sidley |
| 4,948,134 | A | 8/1990 | Suttle et al. |
| 4,951,950 | A | 8/1990 | Normand et al. |
| 4,969,648 | A | 11/1990 | Hollinger et al. |
| 4,993,587 | A | 2/1991 | Abe |
| 4,995,615 | A | 2/1991 | Cheng |
| 5,000,453 | A | 3/1991 | Stevens et al. |
| 5,039,102 | A | 8/1991 | Miller |
| 5,067,713 | A | 11/1991 | Soules et al. |
| 5,078,405 | A | 1/1992 | Jones et al. |

(56) References Cited

U.S. PATENT DOCUMENTS 5,081,487 A 1/1992 Hoyer et al.
5,096,197 A 3/1992 Embury
5,102,293 A 4/1992 Schneider
5,118,114 A 6/1992 Tucci et al.
5,121,192 A 6/1992 Kazui
5,121,921 A 6/1992 Friedman
5,154,429 A 10/1992 LeVasseur et al.
5,179,517 A 1/1993 Sarbin et al.
5,197,094 A 3/1993 Tillery et al.
5,199,710 A 4/1993 Lamle
5,209,476 A 5/1993 Eiba et al.
5,224,712 A 7/1993 Laughlin et al.
5,240,140 A 8/1993 Huen
5,248,142 A 9/1993 Breeding et al.
5,257,179 A 10/1993 DeMar et al.
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding et al.
5,299,089 A 3/1994 Lwee et al.
5,303,921 A 4/1994 Breeding
5,344,146 A 9/1994 Lee
5,356,145 A 10/1994 Verschoor
5,362,053 A 11/1994 Miller et al.
5,374,061 A 12/1994 Albrecht et al.
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias et al.
5,416,308 A 5/1995 Hood et al.
5,431,399 A 7/1995 Kelley et al.
5,431,407 A 7/1995 Hofberg et al.
5,437,462 A 8/1995 Breeding et al.
5,445,377 A 8/1995 Steinbach
5,470,079 A 11/1995 LeStrange et al.
D365,853 S 1/1996 Zadro
5,489,101 A 2/1996 Moody et al.
5,515,477 A 5/1996 Sutherland
5,524,888 A 6/1996 Heidel
5,531,448 A 7/1996 Moody et al.
5,544,892 A 8/1996 Breeding et al.
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea et al.
5,613,912 A 3/1997 Slater et al.
5,632,483 A 5/1997 Garczynski et al.
5,636,843 A 6/1997 Roberts et al.
5,651,548 A 7/1997 French et al.
5,655,961 A 8/1997 Acres et al.
5,669,816 A 9/1997 Garczynski et al.
5,676,231 A 10/1997 Legras et al.
5,676,372 A 10/1997 Sines et al.
5,681,039 A 10/1997 Miller et al.
5,683,085 A 11/1997 Johnson et al.
5,685,543 A 11/1997 Garner et al.
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea et al.
5,711,525 A 1/1998 Breeding et al.
5,718,427 A 2/1998 Cranford et al.
5,719,288 A 2/1998 Sens et al.
5,720,484 A 2/1998 Hsu et al.
5,722,893 A 3/1998 Hill et al.
5,735,525 A 4/1998 McCrea et al.
5,735,724 A 4/1998 Udagawa
5,735,742 A 4/1998 French et al.
5,743,798 A 4/1998 Adams et al.
5,768,382 A 6/1998 Schneier et al.
5,770,533 A 6/1998 Franchi et al.
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 van Putten et al.
5,788,574 A 8/1998 Ornstein et al.
5,791,988 A 8/1998 Nomi et al.
5,802,560 A 9/1998 Joseph et al.
5,803,808 A 9/1998 Strisower
5,810,355 A 9/1998 Trilli
5,813,326 A 9/1998 Salomon et al.
5,813,912 A 9/1998 Shultz et al.
5,814,796 A 9/1998 Benson et al.
5,836,775 A 11/1998 Hiyama et al.
5,839,730 A 11/1998 Pike
5,845,906 A 12/1998 Wirth et al.
5,851,011 A 12/1998 Lott et al.
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,911,626 A 6/1999 McCrea et al.
5,919,090 A 7/1999 Mothwurf
5,936,222 A 8/1999 Korsunsky et al.
5,941,769 A 8/1999 Order
5,944,310 A 8/1999 Johnson et al.
D414,527 S 9/1999 Tedham
5,957,776 A 9/1999 Hoehne et al.
5,974,150 A 10/1999 Kaish et al.
5,985,305 A 11/1999 Peery et al.
5,989,122 A 11/1999 Roblejo et al.
5,991,308 A 11/1999 Fuhrmann et al.
6,015,311 A 1/2000 Benjamin et al.
6,019,368 A 2/2000 Sines et al.
6,019,374 A 2/2000 Breeding et al.
6,039,650 A 3/2000 Hill et al.
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea et al.
6,113,101 A 9/2000 Wirth et al.
6,117,012 A 9/2000 McCrea et al.
D432,588 S 10/2000 Tedham
6,126,166 A 10/2000 Lorson et al.
6,127,447 A 10/2000 Mitry et al.
6,131,817 A 10/2000 Miller
6,139,014 A 10/2000 Breeding et al.
6,149,154 A 11/2000 Grauzer et al.
6,154,131 A 11/2000 Jones et al.
6,165,069 A 12/2000 Sines et al.
6,165,072 A 12/2000 Davis et al.
6,183,362 B1 2/2001 Boushy
6,186,895 B1 2/2001 Oliver
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero

(56) References Cited

U.S. PATENT DOCUMENTS

| | | | |
|---|---|---|---|
| 6,299,167 | B1 | 10/2001 | Sines et al. |
| 6,299,534 | B1 | 10/2001 | Breeding et al. |
| 6,299,536 | B1 | 10/2001 | Hill |
| 6,308,886 | B1 | 10/2001 | Benson et al. |
| 6,313,871 | B1 | 11/2001 | Schubert |
| 6,325,373 | B1 | 12/2001 | Breeding et al. |
| 6,334,614 | B1 | 1/2002 | Breeding |
| 6,341,778 | B1 | 1/2002 | Lee |
| 6,342,830 | B1 | 1/2002 | Want et al. |
| 6,346,044 | B1 | 2/2002 | McCrea, Jr. |
| 6,361,044 | B1 | 3/2002 | Block et al. |
| 6,386,973 | B1 | 5/2002 | Yoseloff |
| 6,402,142 | B1 | 6/2002 | Warren et al. |
| 6,403,908 | B2 | 6/2002 | Stardust et al. |
| 6,443,839 | B2 | 9/2002 | Stockdale |
| 6,446,864 | B1 | 9/2002 | Kim et al. |
| 6,454,266 | B1 | 9/2002 | Breeding et al. |
| 6,460,848 | B1 | 10/2002 | Soltys et al. |
| 6,464,584 | B2 | 10/2002 | Oliver |
| 6,490,277 | B1 | 12/2002 | Tzotzkov |
| 6,508,709 | B1 | 1/2003 | Karmarkar |
| 6,514,140 | B1 | 2/2003 | Storch |
| 6,517,435 | B2 | 2/2003 | Soltys et al. |
| 6,517,436 | B2 | 2/2003 | Soltys et al. |
| 6,520,857 | B2 | 2/2003 | Soltys et al. |
| 6,527,271 | B2 | 3/2003 | Soltys et al. |
| 6,530,836 | B2 | 3/2003 | Soltys et al. |
| 6,530,837 | B2 | 3/2003 | Soltys et al. |
| 6,532,297 | B1 | 3/2003 | Lindquist |
| 6,533,276 | B2 | 3/2003 | Soltys et al. |
| 6,533,662 | B2 | 3/2003 | Soltys et al. |
| 6,561,897 | B1 | 5/2003 | Bourbour et al. |
| 6,568,678 | B2 | 5/2003 | Breeding et al. |
| 6,579,180 | B2 | 6/2003 | Soltys et al. |
| 6,579,181 | B2 | 6/2003 | Soltys et al. |
| 6,581,747 | B1 | 6/2003 | Charlier et al. |
| 6,582,301 | B2 | 6/2003 | Hill |
| 6,582,302 | B2 | 6/2003 | Romero |
| 6,585,586 | B1 | 7/2003 | Romero |
| 6,585,588 | B2 | 7/2003 | Hartl |
| 6,585,856 | B2 | 7/2003 | Zwick et al. |
| 6,588,750 | B1 | 7/2003 | Grauzer et al. |
| 6,588,751 | B1 | 7/2003 | Grauzer et al. |
| 6,595,857 | B2 | 7/2003 | Soltys et al. |
| 6,609,710 | B1 | 8/2003 | Order |
| 6,612,928 | B1 | 9/2003 | Bradford et al. |
| 6,616,535 | B1 | 9/2003 | Nishizaki et al. |
| 6,619,662 | B2 | 9/2003 | Miller |
| 6,622,185 | B1 | 9/2003 | Johnson |
| 6,626,757 | B2 | 9/2003 | Oliveras |
| 6,629,019 | B2 | 9/2003 | Legge et al. |
| 6,629,591 | B1 | 10/2003 | Griswold et al. |
| 6,629,889 | B2 | 10/2003 | Mothwurf |
| 6,629,894 | B1 | 10/2003 | Purton |
| 6,637,622 | B1 | 10/2003 | Robinson |
| 6,638,161 | B2 | 10/2003 | Soltys et al. |
| 6,645,068 | B1 | 11/2003 | Kelly et al. |
| 6,645,077 | B2 | 11/2003 | Rowe |
| 6,651,981 | B2 | 11/2003 | Grauzer et al. |
| 6,651,982 | B2 | 11/2003 | Grauzer et al. |
| 6,651,985 | B2 | 11/2003 | Sines et al. |
| 6,652,379 | B2 | 11/2003 | Soltys et al. |
| 6,655,684 | B2 | 12/2003 | Grauzer et al. |
| 6,655,690 | B1 | 12/2003 | Oskwarek |
| 6,658,135 | B1 | 12/2003 | Morito et al. |
| 6,659,460 | B2 | 12/2003 | Blaha et al. |
| 6,659,461 | B2 | 12/2003 | Yoseloff et al. |
| 6,659,875 | B2 | 12/2003 | Purton |
| 6,663,490 | B2 | 12/2003 | Soltys et al. |
| 6,666,768 | B1 | 12/2003 | Akers |
| 6,671,358 | B1 | 12/2003 | Seidman et al. |
| 6,676,127 | B2 | 1/2004 | Johnson et al. |
| 6,676,517 | B2 | 1/2004 | Beavers |
| 6,680,843 | B2 | 1/2004 | Farrow et al. |
| 6,685,564 | B2 | 2/2004 | Oliver |
| 6,685,567 | B2 | 2/2004 | Cockerille et al. |
| 6,685,568 | B2 | 2/2004 | Soltys et al. |
| 6,688,597 | B2 | 2/2004 | Jones |
| 6,688,979 | B2 | 2/2004 | Soltys et al. |
| 6,690,673 | B1 | 2/2004 | Jarvis |
| 6,698,756 | B1 | 3/2004 | Baker et al. |
| 6,698,759 | B2 | 3/2004 | Webb et al. |
| 6,702,289 | B1 | 3/2004 | Feola |
| 6,702,290 | B2 | 3/2004 | Buono-Correa et al. |
| 6,709,333 | B1 | 3/2004 | Bradford et al. |
| 6,712,696 | B2 | 3/2004 | Soltys et al. |
| 6,719,288 | B2 | 4/2004 | Hessing et al. |
| 6,719,634 | B2 | 4/2004 | Mishina et al. |
| 6,722,974 | B2 | 4/2004 | Sines et al. |
| 6,726,205 | B1 | 4/2004 | Purton |
| 6,732,067 | B1 | 5/2004 | Powderly |
| 6,733,012 | B2 | 5/2004 | Bui et al. |
| 6,733,388 | B2 | 5/2004 | Mothwurf |
| 6,746,333 | B1 | 6/2004 | Onda et al. |
| 6,747,560 | B2 | 6/2004 | Stevens, III |
| 6,749,510 | B2 | 6/2004 | Giobbi |
| 6,758,751 | B2 | 7/2004 | Soltys et al. |
| 6,758,757 | B2 | 7/2004 | Luciano, Jr. et al. |
| 6,769,693 | B2 | 8/2004 | Huard et al. |
| 6,774,782 | B2 | 8/2004 | Runyon et al. |
| 6,789,801 | B2 | 9/2004 | Snow |
| 6,802,510 | B1 | 10/2004 | Haber |
| 6,804,763 | B1 | 10/2004 | Stockdale et al. |
| 6,808,173 | B2 | 10/2004 | Snow |
| 6,827,282 | B2 | 12/2004 | Silverbrook |
| 6,834,251 | B1 | 12/2004 | Fletcher |
| 6,840,517 | B2 | 1/2005 | Snow |
| 6,842,263 | B1 | 1/2005 | Saeki |
| 6,843,725 | B2 | 1/2005 | Nelson |
| 6,848,616 | B2 | 2/2005 | Tsirline et al. |
| 6,848,844 | B2 | 2/2005 | McCue, Jr. et al. |
| 6,848,994 | B1 | 2/2005 | Knust et al. |
| 6,857,961 | B2 | 2/2005 | Soltys et al. |
| 6,874,784 | B1 | 4/2005 | Promutico |
| 6,874,786 | B2 | 4/2005 | Bruno |
| 6,877,657 | B2 | 4/2005 | Ranard et al. |
| 6,877,748 | B1 | 4/2005 | Patroni |
| 6,886,829 | B2 | 5/2005 | Hessing et al. |
| 6,889,979 | B2 | 5/2005 | Blaha et al. |
| 6,893,347 | B1 | 5/2005 | Zilliacus et al. |
| 6,899,628 | B2 | 5/2005 | Leen et al. |
| 6,902,167 | B2 | 6/2005 | Webb |
| 6,905,121 | B1 | 6/2005 | Timpano |
| 6,923,446 | B2 | 8/2005 | Snow |
| 6,938,900 | B2 | 9/2005 | Snow |
| 6,941,180 | B1 | 9/2005 | Fischer et al. |
| 6,950,948 | B2 | 9/2005 | Neff |
| 6,955,599 | B2 | 10/2005 | Bourbour et al. |
| 6,957,746 | B2 | 10/2005 | Martin et al. |
| 6,959,925 | B1 | 11/2005 | Baker et al. |
| 6,959,935 | B2 | 11/2005 | Buhl et al. |
| 6,960,134 | B2 | 11/2005 | Hartl et al. |
| 6,964,612 | B2 | 11/2005 | Soltys et al. |
| 6,986,514 | B2 | 1/2006 | Snow |
| 6,988,516 | B2 | 1/2006 | Debaes et al. |
| 7,011,309 | B2 | 3/2006 | Soltys et al. |
| 7,020,307 | B2 | 3/2006 | Hinton et al. |
| 7,028,598 | B2 | 4/2006 | Teshima |
| 7,029,009 | B2 | 4/2006 | Grauzer et al. |
| 7,036,818 | B2 | 5/2006 | Grauzer et al. |
| 7,046,458 | B2 | 5/2006 | Nakayama |
| 7,046,764 | B1 | 5/2006 | Kump |
| 7,048,629 | B2 | 5/2006 | Sines et al. |
| 7,059,602 | B2 | 6/2006 | Grauzer et al. |
| 7,066,464 | B2 | 6/2006 | Blad et al. |
| 7,068,822 | B2 | 6/2006 | Scott |
| 7,073,791 | B2 | 7/2006 | Grauzer et al. |
| 7,084,769 | B2 | 8/2006 | Bauer et al. |
| 7,089,420 | B1 | 8/2006 | Durst et al. |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,124,947 | B2 | 10/2006 | Storch |
| 7,128,652 | B1 | 10/2006 | Lavoie et al. |

(56) References Cited

U.S. PATENT DOCUMENTS

| | | | |
|---|---|---|---|
| 7,137,627 | B2 | 11/2006 | Grauzer et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,213,812 | B2 | 5/2007 | Schubert et al. |
| 7,222,852 | B2 | 5/2007 | Soltys et al. |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,344 | B2 | 8/2007 | Grauzer et al. |
| 7,255,351 | B2 | 8/2007 | Yoseloff et al. |
| 7,255,642 | B2 | 8/2007 | Sines et al. |
| 7,257,630 | B2 | 8/2007 | Cole et al. |
| 7,261,294 | B2 | 8/2007 | Grauzer et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,309,065 | B2 | 12/2007 | Yoseloff et al. |
| 7,316,609 | B2 | 1/2008 | Dunn et al. |
| 7,316,615 | B2 | 1/2008 | Soltys et al. |
| 7,322,576 | B2 | 1/2008 | Grauzer et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| 7,357,321 | B2 | 4/2008 | Yoshida et al. |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,884 | B2 | 5/2008 | Breeding et al. |
| 7,374,170 | B2 | 5/2008 | Grauzer et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,390,256 | B2 | 6/2008 | Soltys et al. |
| 7,399,226 | B2 | 7/2008 | Mishra |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,436,957 | B1 | 10/2008 | Fischer et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,537,216 | B2 | 5/2009 | Soltys et al. |
| 7,540,497 | B2 | 6/2009 | Tseng |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida et al. |
| 7,556,266 | B2 | 7/2009 | Blaha et al. |
| 7,575,237 | B2 | 8/2009 | Snow |
| 7,578,506 | B2 | 8/2009 | Lambert |
| 7,584,962 | B2 | 9/2009 | Breeding et al. |
| 7,584,963 | B2 | 9/2009 | Krenn et al. |
| 7,584,966 | B2 | 9/2009 | Snow |
| 7,591,728 | B2 | 9/2009 | Gioia et al. |
| 7,593,544 | B2 | 9/2009 | Downs, III et al. |
| 7,594,660 | B2 | 9/2009 | Baker et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,852 | B2 | 3/2010 | Baker et al. |
| 7,669,853 | B2 | 3/2010 | Jones |
| 7,677,565 | B2 | 3/2010 | Grauzer et al. |
| 7,677,566 | B2 | 3/2010 | Krenn et al. |
| 7,686,681 | B2 | 3/2010 | Soltys et al. |
| 7,699,694 | B2 | 4/2010 | Hill |
| 7,735,657 | B2 | 6/2010 | Johnson |
| 7,740,244 | B2 | 6/2010 | Ho |
| 7,744,452 | B2 | 6/2010 | Cimring et al. |
| 7,753,373 | B2 | 7/2010 | Grauzer et al. |
| 7,753,374 | B2 | 7/2010 | Ho |
| 7,753,798 | B2 | 7/2010 | Soltys et al. |
| 7,762,554 | B2 | 7/2010 | Ho |
| 7,764,836 | B2 | 7/2010 | Downs, III et al. |
| 7,766,332 | B2 | 8/2010 | Grauzer et al. |
| 7,766,333 | B1 | 8/2010 | Stardust et al. |
| 7,769,232 | B2 | 8/2010 | Downs, III |
| 7,769,853 | B2 | 8/2010 | Nezamzadeh |
| 7,773,749 | B1 | 8/2010 | Durst et al. |
| 7,780,529 | B2 | 8/2010 | Rowe et al. |
| 7,784,790 | B2 | 8/2010 | Grauzer et al. |
| 7,804,982 | B2 | 9/2010 | Howard et al. |
| 7,846,020 | B2 | 12/2010 | Walker et al. |
| 7,867,080 | B2 | 1/2011 | Nicely et al. |
| 7,890,365 | B2 | 2/2011 | Hettinger |
| 7,900,923 | B2 | 3/2011 | Toyama et al. |
| 7,901,285 | B2 | 3/2011 | Tran et al. |
| 7,908,169 | B2 | 3/2011 | Hettinger |
| 7,909,689 | B2 | 3/2011 | Lardie |
| 7,931,533 | B2 | 4/2011 | LeMay et al. |
| 7,933,448 | B2 | 4/2011 | Downs, III |
| 7,946,586 | B2 | 5/2011 | Krenn et al. |
| 7,967,294 | B2 | 6/2011 | Blaha et al. |
| 7,976,023 | B1 | 7/2011 | Hessing et al. |
| 7,988,152 | B2 * | 8/2011 | Sines ..... 273/149 R |
| 7,988,554 | B2 | 8/2011 | LeMay et al. |
| 7,995,196 | B1 | 8/2011 | Fraser |
| 8,002,638 | B2 | 8/2011 | Grauzer et al. |
| 8,011,661 | B2 | 9/2011 | Stasson |
| 8,016,663 | B2 | 9/2011 | Soltys et al. |
| 8,021,231 | B2 | 9/2011 | Walker et al. |
| 8,025,294 | B2 | 9/2011 | Grauzer et al. |
| 8,038,521 | B2 | 10/2011 | Grauzer et al. |
| RE42,944 | E | 11/2011 | Blaha et al. |
| 8,057,302 | B2 | 11/2011 | Wells et al. |
| 8,062,134 | B2 | 11/2011 | Kelly et al. |
| 8,070,574 | B2 | 12/2011 | Grauzer et al. |
| 8,092,307 | B2 | 1/2012 | Kelly |
| 8,092,309 | B2 | 1/2012 | Bickley |
| 8,141,875 | B2 | 3/2012 | Grauzer et al. |
| 8,150,158 | B2 | 4/2012 | Downs, III |
| 8,171,567 | B1 | 5/2012 | Fraser et al. |
| 8,210,536 | B2 | 7/2012 | Blaha et al. |
| 8,221,244 | B2 | 7/2012 | French |
| 8,251,293 | B2 | 8/2012 | Nagata et al. |
| 8,267,404 | B2 | 9/2012 | Grauzer et al. |
| 8,270,603 | B1 | 9/2012 | Durst et al. |
| 8,287,347 | B2 | 10/2012 | Snow et al. |
| 8,287,386 | B2 | 10/2012 | Miller et al. |
| 8,319,666 | B2 | 11/2012 | Weinmann et al. |

(56) References Cited

U.S. PATENT DOCUMENTS

| | | | |
|---|---|---|---|
| 8,337,296 | B2 | 12/2012 | Grauzer et al. |
| 8,342,525 | B2 | 1/2013 | Scheper et al. |
| 8,342,526 | B1 | 1/2013 | Sampson et al. |
| 8,342,529 | B2 | 1/2013 | Snow |
| 8,353,513 | B2 | 1/2013 | Swanson |
| 8,381,918 | B2 | 2/2013 | Johnson |
| 8,419,521 | B2 | 4/2013 | Grauzer et al. |
| 8,444,147 | B2 | 5/2013 | Grauzer et al. |
| 8,469,360 | B2 | 6/2013 | Sines |
| 8,480,088 | B2 | 7/2013 | Toyama et al. |
| 8,485,527 | B2 | 7/2013 | Sampson et al. |
| 8,490,973 | B2 | 7/2013 | Yoseloff et al. |
| 8,498,444 | B2 | 7/2013 | Sharma |
| 8,505,916 | B2 | 8/2013 | Grauzer et al. |
| 8,511,684 | B2 | 8/2013 | Grauzer et al. |
| 8,556,263 | B2 | 10/2013 | Grauzer et al. |
| 8,579,289 | B2 | 11/2013 | Rynda et al. |
| 8,616,552 | B2 | 12/2013 | Czyzewski et al. |
| 8,628,086 | B2 | 1/2014 | Krenn et al. |
| 8,662,500 | B2 | 3/2014 | Swanson |
| 8,695,978 | B1 | 4/2014 | Ho |
| 8,702,100 | B2 | 4/2014 | Snow et al. |
| 8,702,101 | B2 | 4/2014 | Scheper et al. |
| 8,720,891 | B2 | 5/2014 | Hessing et al. |
| 8,758,111 | B2 | 6/2014 | Lutnick |
| 8,777,710 | B2 | 7/2014 | Grauzer et al. |
| 8,820,745 | B2 | 9/2014 | Grauzer et al. |
| 8,899,587 | B2 | 12/2014 | Grauzer et al. |
| 8,919,775 | B2 | 12/2014 | Wadds et al. |
| 2001/0036231 | A1 | 11/2001 | Easwar et al. |
| 2001/0036866 | A1 | 11/2001 | Stockdale et al. |
| 2002/0017481 | A1 | 2/2002 | Johnson et al. |
| 2002/0030425 | A1 | 3/2002 | Tiramani et al. |
| 2002/0045478 | A1 | 4/2002 | Soltys et al. |
| 2002/0045481 | A1 | 4/2002 | Soltys et al. |
| 2002/0063389 | A1 | 5/2002 | Breeding et al. |
| 2002/0068635 | A1 | 6/2002 | Hill |
| 2002/0070499 | A1 | 6/2002 | Breeding et al. |
| 2002/0094869 | A1 | 7/2002 | Harkham |
| 2002/0107067 | A1 | 8/2002 | McGlone et al. |
| 2002/0107072 | A1 | 8/2002 | Giobbi |
| 2002/0113368 | A1 | 8/2002 | Hessing et al. |
| 2002/0135692 | A1 | 9/2002 | Fujinawa |
| 2002/0142820 | A1 | 10/2002 | Bartlett |
| 2002/0155869 | A1 | 10/2002 | Soltys et al. |
| 2002/0163125 | A1 | 11/2002 | Grauzer et al. |
| 2002/0187821 | A1 | 12/2002 | Soltys et al. |
| 2002/0187830 | A1 | 12/2002 | Stockdale et al. |
| 2003/0003997 | A1 | 1/2003 | Vuong et al. |
| 2003/0007143 | A1 | 1/2003 | McArthur et al. |
| 2003/0047870 | A1 | 3/2003 | Blaha et al. |
| 2003/0048476 | A1 | 3/2003 | Yamakawa |
| 2003/0052449 | A1 | 3/2003 | Grauzer et al. |
| 2003/0052450 | A1 | 3/2003 | Grauzer et al. |
| 2003/0064798 | A1 | 4/2003 | Grauzer et al. |
| 2003/0067112 | A1 | 4/2003 | Grauzer et al. |
| 2003/0071413 | A1 | 4/2003 | Blaha et al. |
| 2003/0073498 | A1 | 4/2003 | Grauzer et al. |
| 2003/0075865 | A1 | 4/2003 | Grauzer et al. |
| 2003/0075866 | A1 | 4/2003 | Blaha et al. |
| 2003/0087694 | A1 | 5/2003 | Storch |
| 2003/0090059 | A1 | 5/2003 | Grauzer et al. |
| 2003/0094756 | A1 | 5/2003 | Grauzer et al. |
| 2003/0151194 | A1 | 8/2003 | Hessing et al. |
| 2003/0195025 | A1 | 10/2003 | Hill |
| 2004/0015423 | A1 | 1/2004 | Walker et al. |
| 2004/0036214 | A1 | 2/2004 | Baker et al. |
| 2004/0067789 | A1 | 4/2004 | Grauzer et al. |
| 2004/0100026 | A1 | 5/2004 | Haggard |
| 2004/0108654 | A1 | 6/2004 | Grauzer et al. |
| 2004/0116179 | A1 | 6/2004 | Nicely et al. |
| 2004/0169332 | A1 | 9/2004 | Grauzer et al. |
| 2004/0180722 | A1 | 9/2004 | Giobbi |
| 2004/0224777 | A1 | 11/2004 | Smith et al. |
| 2004/0245720 | A1 | 12/2004 | Grauzer et al. |
| 2004/0259618 | A1 | 12/2004 | Soltys et al. |
| 2005/0012671 | A1 | 1/2005 | Bisig |
| 2005/0023752 | A1 | 2/2005 | Grauzer et al. |
| 2005/0026680 | A1 | 2/2005 | Gururajan |
| 2005/0035548 | A1 | 2/2005 | Yoseloff et al. |
| 2005/0037843 | A1 | 2/2005 | Wells et al. |
| 2005/0040594 | A1 | 2/2005 | Krenn et al. |
| 2005/0051955 | A1 | 3/2005 | Schubert et al. |
| 2005/0051956 | A1 | 3/2005 | Grauzer et al. |
| 2005/0062227 | A1 | 3/2005 | Grauzer et al. |
| 2005/0062228 | A1 | 3/2005 | Grauzer et al. |
| 2005/0062229 | A1 | 3/2005 | Grauzer et al. |
| 2005/0082750 | A1 | 4/2005 | Grauzer et al. |
| 2005/0093230 | A1 | 5/2005 | Grauzer et al. |
| 2005/0093231 | A1 | 5/2005 | Grauzer et al. |
| 2005/0104289 | A1 | 5/2005 | Grauzer et al. |
| 2005/0104290 | A1 | 5/2005 | Grauzer et al. |
| 2005/0110210 | A1 | 5/2005 | Soltys et al. |
| 2005/0110211 | A1 | 5/2005 | Blad et al. |
| 2005/0113166 | A1 | 5/2005 | Grauzer et al. |
| 2005/0113171 | A1 | 5/2005 | Hodgson |
| 2005/0119048 | A1 | 6/2005 | Soltys et al. |
| 2005/0137005 | A1 | 6/2005 | Soltys et al. |
| 2005/0140090 | A1 | 6/2005 | Breeding et al. |
| 2005/0146093 | A1 | 7/2005 | Grauzer et al. |
| 2005/0148391 | A1 | 7/2005 | Tain |
| 2005/0192092 | A1 | 9/2005 | Breckner et al. |
| 2005/0206077 | A1 | 9/2005 | Grauzer et al. |
| 2005/0242500 | A1 | 11/2005 | Downs |
| 2005/0272501 | A1 | 12/2005 | Tran et al. |
| 2005/0288083 | A1 | 12/2005 | Downs |
| 2005/0288086 | A1 | 12/2005 | Schubert et al. |
| 2006/0027970 | A1 | 2/2006 | Kyrychenko |
| 2006/0033269 | A1 | 2/2006 | Grauzer et al. |
| 2006/0033270 | A1 | 2/2006 | Grauzer et al. |
| 2006/0046853 | A1 | 3/2006 | Black |
| 2006/0063577 | A1 | 3/2006 | Downs et al. |
| 2006/0066048 | A1 | 3/2006 | Krenn et al. |
| 2006/0181022 | A1 | 8/2006 | Grauzer et al. |
| 2006/0183540 | A1 | 8/2006 | Grauzer et al. |
| 2006/0189381 | A1 | 8/2006 | Daniel et al. |
| 2006/0199649 | A1 | 9/2006 | Soltys et al. |
| 2006/0205508 | A1 | 9/2006 | Green |
| 2006/0220312 | A1 | 10/2006 | Baker et al. |
| 2006/0220313 | A1 | 10/2006 | Baker et al. |
| 2006/0252521 | A1 | 11/2006 | Gururajan et al. |
| 2006/0252554 | A1 | 11/2006 | Gururajan et al. |
| 2006/0279040 | A1 | 12/2006 | Downs et al. |
| 2006/0281534 | A1 | 12/2006 | Grauzer et al. |
| 2007/0001395 | A1 | 1/2007 | Gioia et al. |
| 2007/0006708 | A1 | 1/2007 | Laakso |
| 2007/0015583 | A1 | 1/2007 | Tran |
| 2007/0018389 | A1 | 1/2007 | Downs |
| 2007/0045959 | A1 | 3/2007 | Soltys |
| 2007/0049368 | A1 | 3/2007 | Kuhn et al. |
| 2007/0057469 | A1 | 3/2007 | Grauzer et al. |
| 2007/0066387 | A1 | 3/2007 | Matsuno et al. |
| 2007/0069462 | A1 | 3/2007 | Downs et al. |
| 2007/0072677 | A1 | 3/2007 | Lavoie et al. |
| 2007/0102879 | A1 | 5/2007 | Stasson |
| 2007/0111773 | A1 | 5/2007 | Gururajan et al. |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0222147 | A1 | 9/2007 | Blaha et al. |
| 2007/0225055 | A1 | 9/2007 | Weisman |
| 2007/0233567 | A1 | 10/2007 | Daly |
| 2007/0238506 | A1 | 10/2007 | Ruckle |
| 2007/0259709 | A1 | 11/2007 | Kelly et al. |
| 2007/0267812 | A1 | 11/2007 | Grauzer et al. |
| 2007/0272600 | A1 | 11/2007 | Johnson |
| 2007/0278739 | A1 | 12/2007 | Swanson |
| 2007/0290438 | A1 | 12/2007 | Grauzer et al. |
| 2008/0006997 | A1 | 1/2008 | Scheper et al. |
| 2008/0006998 | A1 | 1/2008 | Grauzer et al. |
| 2008/0022415 | A1 | 1/2008 | Kuo et al. |
| 2008/0032763 | A1 | 2/2008 | Giobbi |
| 2008/0039192 | A1 | 2/2008 | Laut |

(56) References Cited

U.S. PATENT DOCUMENTS

| | | | |
|---|---|---|---|
| 2008/0039208 | A1 | 2/2008 | Abrink et al. |
| 2008/0096656 | A1 | 4/2008 | LeMay et al. |
| 2008/0111300 | A1 | 5/2008 | Czyzewski et al. |
| 2008/0113700 | A1 | 5/2008 | Czyzewski et al. |
| 2008/0113783 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0303210 | A1 | 12/2008 | Grauzer et al. |
| 2008/0315517 | A1 | 12/2008 | Toyama |
| 2009/0026700 | A2 | 1/2009 | Shigeta |
| 2009/0048026 | A1 | 2/2009 | French |
| 2009/0054161 | A1 | 2/2009 | Schubert et al. |
| 2009/0072477 | A1 | 3/2009 | Tseng |
| 2009/0091078 | A1 | 4/2009 | Grauzer et al. |
| 2009/0100409 | A1 | 4/2009 | Toneguzzo |
| 2009/0104963 | A1 | 4/2009 | Burman |
| 2009/0121429 | A1 | 5/2009 | Walsh |
| 2009/0140492 | A1 | 6/2009 | Yoseloff et al. |
| 2009/0166970 | A1 | 7/2009 | Rosh |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho |
| 2009/0267297 | A1 | 10/2009 | Blaha et al. |
| 2009/0283969 | A1 | 11/2009 | Tseng |
| 2009/0298577 | A1 | 12/2009 | Gagner et al. |
| 2009/0302535 | A1 | 12/2009 | Ho |
| 2009/0302537 | A1 | 12/2009 | Ho |
| 2009/0312093 | A1 | 12/2009 | Walker et al. |
| 2009/0314188 | A1 | 12/2009 | Toyama et al. |
| 2010/0013152 | A1 | 1/2010 | Grauzer et al. |
| 2010/0038849 | A1 | 2/2010 | Scheper et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0244382 | A1 | 9/2010 | Snow |
| 2010/0252992 | A1 | 10/2010 | Sines |
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer et al. |
| 2011/0006480 | A1 | 1/2011 | Grauzer et al. |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta et al. |
| 2011/0078096 | A1 | 3/2011 | Bounds |
| 2011/0105208 | A1 | 5/2011 | Bickley |
| 2011/0109042 | A1 | 5/2011 | Rynda et al. |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230268 | A1 | 9/2011 | Williams |
| 2011/0269529 | A1 | 11/2011 | Baerlocher |
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer et al. |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0085638 | A1 | 4/2013 | Weinmann et al. |
| 2013/0099448 | A1 | 4/2013 | Scheper et al. |
| 2013/0109455 | A1 | 5/2013 | Grauzer et al. |
| 2013/0132306 | A1 | 5/2013 | Kami et al. |
| 2013/0228972 | A1 | 9/2013 | Grauzer et al. |
| 2013/0300059 | A1 | 11/2013 | Sampson et al. |
| 2013/0337922 | A1 | 12/2013 | Kuhn |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |

FOREIGN PATENT DOCUMENTS

| | | | |
|---|---|---|---|
| CA | 2266555 | | 9/1996 |
| CA | 2284017 | A1 | 9/1998 |
| CA | 2612138 | A1 | 12/2006 |
| CN | 101127131 | A | 2/2008 |
| CN | 201139926 | Y | 10/2008 |
| CZ | 24952 | U1 | 2/2013 |
| DE | 672616 | | 11/1949 |
| DE | 2757341 | A1 | 6/1978 |
| DE | 3807127 | A1 | 9/1989 |
| EM | 1502631 | A1 | 2/2005 |
| EP | 777514 | A1 | 2/2000 |
| EP | 1194888 | A1 | 4/2002 |
| EP | 1713026 | A1 | 10/2006 |
| EP | 1575261 | B1 | 8/2012 |
| FR | 2375918 | A1 | 7/1978 |
| GB | 337147 | A | 10/1930 |
| GB | 414014 | * | 7/1934 |
| JP | 10063933 | A | 3/1998 |
| JP | 11045321 | A | 2/1999 |
| JP | 2000251031 | A | 9/2000 |
| JP | 2001-327647 | A | 11/2001 |
| JP | 2002165916 | A | 6/2002 |
| JP | 2003250950 | A | 9/2003 |
| JP | 2005-198668 | A | 7/2005 |
| JP | 2008246061 | A | 10/2008 |
| WF | 9607153 | A1 | 3/1996 |
| WO | 8700764 | | 2/1987 |
| WO | 9221413 | A1 | 12/1992 |
| WO | 9528210 | A1 | 10/1995 |
| WO | 9710577 | A1 | 3/1997 |
| WO | 9814249 | A1 | 4/1998 |
| WO | 9840136 | | 9/1998 |
| WO | 9840136 | A1 | 9/1998 |
| WO | 9943404 | A1 | 9/1999 |
| WO | 9952610 | A1 | 10/1999 |

(56) References Cited

FOREIGN PATENT DOCUMENTS

| | | | |
|---|---|---|---|
| WO | 9952611 | A1 | 10/1999 |
| WO | 00/51076 | | 8/2000 |
| WO | 0051076 | | 8/2000 |
| WO | 0156670 | A1 | 8/2001 |
| WO | 0205914 | A1 | 1/2002 |
| WO | 2004067889 | A1 | 8/2004 |
| WO | 2004112923 | A1 | 12/2004 |
| WO | 2006031472 | A2 | 3/2006 |
| WO | 2006039308 | A2 | 4/2006 |
| WO | 2008005286 | A2 | 1/2008 |
| WO | 2008006023 | A2 | 1/2008 |
| WO | 2008091809 | A2 | 7/2008 |
| WO | 2009137541 | A2 | 11/2009 |
| WO | 2010001032 | A1 | 1/2010 |
| WO | 2010055328 | A1 | 5/2010 |
| WO | 2010/117446 | | 10/2010 |
| WO | 2013019677 | A1 | 2/2013 |

OTHER PUBLICATIONS

DVD Labeled "Luciano Decl. Ex. K". This is video taped live Declaration of Mr. Luciano (see list of patents on the 1449 or of record in the file history) taken during prepartion of litigation (Oct. 23, 2003). DVD sent to Examiner by US Postal Service with copy of this PTO/SB/08 form.

DVD labeled Morrill Decl. Ex. A:. This is the video taped live Declaration of Mr. Robert Morrill, a lead trial counsel for the defense, taken during preparation for litigation. He is describing the operation of the Roblejo Prototype device. See Roblejo patent in 1449 or of record (Jan. 15, 2004). DVD sent to Examiner by US Postal Service with copy of this PTO/SB/08 form.

DVD Labeled "Solberg Decl. Ex. C". Exhibit C to Declaration of Hal Solberg, a witness in litigation, signed Dec. 1, 2003. DVD sent to Examiner by US Postal Service with copy of this PTO/SB/08 form.

DVD labeled "Exhibit 1". This is a video taken by Shuffle Master personnel of the live operation of a CARD One2Six™ Shuffler (Oct. 7, 2003). DVD sent to Examiner by US Postal Service with copy of this PTO/SB/08 form.

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 21 (Master Index and Binder 1, 1 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 21 (Master Index and Binder 1, 2 of 2).

Documents submitted in the case of Shuffle Master, Inc. v. Card Austria, et al., Case No. CV-N-0508-HDM-(VPC) (Consolidated with Case No. CV-N-02-0244-ERC-(RAM)), May 6, 2003, Part 3 of 21 (Binder 2, 1 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 21 (Binder 2, 2 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 21 (Binder 3, 1 of 3).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 21 (Binder 3, 2 and 3 of 3).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 7 of 21 (Binder 4, 1 and 2 of 3).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 21 (Binder 4, 3 of 3).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 21 (Binder 5 having no contents; Binder 6, 1 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 21 (Binder 6, 2 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 21 (Binder 7, 1 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 21 (Binder 7, 2 of 2).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 21 (Binder 8, 1 of 5).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 21 (Binder 8, 2 of 5).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 21 (Binder 8, 3 of 5).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 21 (Binder 8, 4 and 5 of 5).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, scan of color pages, for clarity, Part 17 of 21 (color copies from Binder 1).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, scan of color pages, for clarity, Part 18 of 21 (color copies from Binder 3).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, scan of color pages, for clarity, Part 19 of 21 (color copies from Binder 4).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, scan of color pages, for clarity, Part 20 of 21 (color copies from Binder 6).

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, scan of color pages, for clarity, Part 21 of 21 (color copies from Binder 8, part 1 and 2).

"ACE, Single Deck Shuffler," Shuffle Master, Inc., (2005), 2 pages.

"Automatic casino card shuffle," Alibaba.com, (last visitited Jul. 22, 2014), 2 pages.

"Error Back propagation," http://willamette.edu~gorr/classes/cs449/backdrop.html (4 pages), Nov. 13, 2008.

"i-Deal," Bally Technologies, Inc., (2014), 2 pages.

"shufflers—SHFL entertainment," Gaming Concepts Group, (2012), 6 pages.

"TAG Archives: Shuffle Machine," Gee Wiz Online, (Mar. 25, 2013), 4 pages.

1/3" B/W CCD Camera Module EB100 by EverFocus Electronics Corp., Jul. 31, 2001, 3 pgs.

Canadian Office Action for CA 2,580,309 dated Mar. 20, 2012 (6 pages).

Christos Stergiou and Dimitrios Siganos, "Neural Networks," http://www.doc.ic.ac.uk/~nd/surprise_96/journal/vol4/cs11/report.html (13 pages), Dec. 15, 2011.

European Patent Application Search Report—European Patent Application No. 06772987.1, Dec. 21, 2009.

(56) References Cited

OTHER PUBLICATIONS

Genevieve Orr, CS-449: Neural Networks Williamette University, http://www.willamette.edu/~gorr/classes/cs449/intro.html (4 pages), Fall 1999.
http://www.google.com/search?tbm=pts &q=Card+handling+devicve+with+input+and+outpu.. Jun. 8, 2012.
http://www.google.com/search?tbm=pts &q=shuffling+zone+onOopposite+site+of+input+... Jul. 18, 2012.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, Sep. 6, 2006.
PCT International Preliminary Examination Report for correspanding International Application No. PCT/US02/31105 filed Sep. 27, 2002.
PCT International Preliminary Report on Patentability of the International Searching Authory for PCT/US05/31400, dated Oct. 16, 2007, 7 pages.
PCT International Search Report and Written Opinion—International Patent Application No. PCT/US2006/22911, Dec. 28, 2006.
PCT International Search Report and Written Opinion for International Application No. PCT/US2007/023168, dated Sep. 12, 2008, 8 pages.
PCT International Search Report and Written Opinion for International Application No. PCT/US2007/022858, mailed Apr. 18, 2008, 7 pages.
PCT International Search Report and Written Opinion for PCT/US07/15036, dated Sep. 23, 2008, 3 pages.
PCT International Search Report and Written Opinion for PCT/US07/15035, dated Sep. 29, 2008, 3 pages.
PCT International Search Report and Written Opinion of the International Searching Authority for PCT/GB2011/051978, dated Jan. 17, 2012, 11 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion of the International Searching Authority for PCT/US13/59665, dated Apr. 25, 2014, 21 pages.
PCT International Search Report and Written Opinion of the International Searching Authority for PCT/US2008/007069, dated Sep. 8, 2008, 10 pages.
PCT International Search Report and Written Opinion, PCT Application No. PCT/US2013/062391, Dec. 17, 2013, 13 pages.
PCT International Search Report and Written Opinion, PCT/US12/48706, Oct. 16, 2012, 12 pages.
PCT International Search Report for International Application Number PCT/US2003/015393, mailed Oct. 6, 2003.
PCT International Search Report for PCT/US2005/034737 dated Apr. 7, 2006 (WO06/039308).
PCT International Search Report for PCT/US2007/022894, dated Jun. 11, 2008, 2 pages.
PCT International Search Report and Written Opinion of the International Searching Authority for PCT/US05/31400, dated Sep. 25, 2007, 8 pages.
Philippines Patent Application Formality Examination Report—Philippines Patent Application No. 1-2006-000302, Jun. 13, 2006.
Press Release for Alliance Gaming Corp., Jul. 26, 2004—Alliance Gaming Announces Control with Galaxy Macau for New MindPlay Baccarat Table Technology, http://biz.yahoo.com/prnews.
Scarne's Encyclopedia of Games by John Scarne, 1973, "Super Contract Bridge", p. 153.
Service Manual/User Manual for Single Deck Shufflers: BG1, BG2 and BG3 by Shuffle Master ©1996.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Shuffle Master's Reply Memorandum in Support of Shuffle Master's Motion for Preliminary Injunction for *Shuffle Master, Inc.* vs. *VendingData Corporation*, In the U.S. District Court, District of Nevada, No. CV-S-04-1373-JCM-LRL, Nov. 29, 2004.
Singapore Patent Application Examination Report—Singapore Patent Application No. SE 2008 01914 A, Aug. 6, 2006.
Specification of Australian Patent Application No. 31577/95, filed Jan. 17, 1995, Applicants: Rodney G. Johnson et al., Title: CARD HANDLING APPARATUS.
Specification of Australian Patent Application No. Not Listed, filed Aug. 15, 1994, Applicants: Rodney G. Johnson et al., Title: CARD HANDLING APPARATUS.
Statement of Relevance of Cited References, Submitted as Part of a Third-Party Submission Under 37 CFR 1.290 on Dec. 7, 2012 (12 pages).
tbm=pts&hl=Google Search for card handling device with storage area, card removing system pivoting arm and processor...; http://www.google.com/?tbrn=pts&hl=en; Jul. 28, 2012.
Tracking the Tables, by Jack Bularsky, Casino Journal, May 2004, vol. 17, No. 5, pp. 44-47.
United States Court of Appeals for the Federal Circuit Decision Decided Dec. 27, 2005 for Preliminary Injunction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffle Master, Inc.* vs. *VendingData Corporation*, In the U.S. District Court, District of Nevada, No. CV-S-04-1373-JCM-LRL, Mar. 14, 2005.
PCT International Search Report and Written Opinion, PCT Application No. PCT/US2015/022158, Jun. 17, 2015, 13 pages.

* cited by examiner

PLAYING CARD SHUFFLER

CROSS-REFERENCE TO RELATED APPLICATIONS

This application is a continuation of U.S. patent application Ser. No. 13/925,249, filed Jun. 24, 2013, now U.S. Pat. No. 8,720,892, issued May 13, 2014, which is a continuation of U.S. patent application Ser. No. 13/101,717, filed May 5, 2011, now U.S. Pat. No. 8,469,360, issued Jun. 25, 2013, which, in turn, is a continuation of U.S. patent application Ser. No. 12/384,732, filed Apr. 7, 2009, now U.S. Pat. No. 7,988,152, issued Aug. 2, 2011. The entire disclosures of each of the foregoing applications are hereby incorporated by reference herein.

TECHNICAL FIELD

The technical field of this invention is shuffling machines for shuffling playing cards used in gaming.

BACKGROUND

Shuffling machines, or shufflers, are widely used in casinos, card rooms and many other venues at which card games are played. Conventional shufflers are typically adapted to receive one or more decks of standard playing cards to be shuffled. The intended purpose of most shufflers is to shuffle the playing cards into what is believed to be a random order. Such a random order of the playing cards is desirable when playing various types of card games such as blackjack, poker and the like. However, in reality most shufflers have tendencies to shuffle or reorder the deck or decks in a manner which skilled card counters can perceive and use to their advantage versus the casino, house or other player. Thus, there is still a need for automated shufflers that function in a manner which more truly randomizes the ordering of a deck or decks of playing cards.

Other problems associated with at least some conventional shufflers include excessive size, excessive weight, excessive mechanical complexity and/or electronic complexity. These complexities also may fail to achieve a suitable degree of shuffling, reordering or recompiling into a truly random order from one shuffling process to another. Accordingly, there is still a need for improved automated shuffling machines for playing cards that produce reordering of card decks in a manner which is closer to true randomness and which is more difficult for skilled card players to decipher to change the odds so as to be relatively favorable to the player versus unfavorable portions of a deck or decks of cards.

One casino game commonly called "blackjack" or "21" is known to be susceptible to card counting and casinos are routinely spending significant amounts of money trying to prevent card counters from taking advantage of non-random sequences in the decks held within a dealing shoe that holds the decks being dealt. Poker has also grown in popularity and is played with a single deck, which makes any knowledge of cards of potential significance to a player.

The inventions shown and described herein may be used to address one or more of such problems or other problems not set out herein and/or which are only understood or appreciated at a later time. The future may also bring to light currently unknown or unrecognized benefits that may be appreciated, or more fully appreciated, in association with the inventions shown and described herein. The desires and expected benefits explained herein are not admissions that others have recognized such prior needs, since invention and discovery are both inventive under the law and may relate to the inventions described herein.

BRIEF DESCRIPTION OF THE DRAWINGS

Preferred forms, configurations, embodiments and/or diagrams relating to and helping to describe preferred aspects and versions of the inventions are explained and characterized herein, often with reference to the accompanying drawings. The drawings and all features shown therein also serve as part of the disclosure of the inventions of the current document, whether described in text or merely by graphical disclosure alone. Such drawings are briefly described below.

DETAILED DESCRIPTION

A table of sections of this detailed description follows.

TABLE OF DETAILED DESCRIPTION SUBSECTIONS

INTRODUCTORY NOTES
GENERAL OVERVIEW

-continued

TABLE OF DETAILED DESCRIPTION SUBSECTIONS

CARD SUPPORTS
CARD REST AND POSITIONER
EXCITER
CARD RECEIVER
CONTROLLER
HOUSING
ALTERNATIVE SUPPORT BIASING OF UNSHUFFLED CARD ARRAY
ALTERNATIVE EMBODIMENT—GATED UNSHUFFLED ARRAY GATED SUPPORT
OPERATION
ALTERNATIVE ASPECTS AND CONFIGURATIONS
METHODS AND MANNERS OF USE
MANNER AND MATERIALS OF MAKING

Introductory Notes

The readers of this document should understand that the embodiments described herein may rely on terminology used in any section of this document and other terms readily apparent from the drawings and the language common therefor as may be known in a particular art and such as known or indicated and provided by dictionaries. Dictionaries were used in the preparation of this document. Widely known and used in the preparation hereof are Webster's Third New International Dictionary (1993), The Oxford English Dictionary, 2$^{nd}$ Ed., 1989, and The New Century Dictionary, 2001-2005, all of which are hereby incorporated by reference for interpretation of terms used herein and for application and use of words defined in such references to more adequately or aptly describe various features, aspects and concepts shown or otherwise described herein using more appropriate words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text and meaning of the claims and Abstract are hereby incorporated by reference into the description in their entirety as originally filed. Terminology used with one, some or all embodiments may be used for describing and defining the technology and exclusive rights associated herewith.

The readers of this document should further understand that the embodiments described herein may rely on terminology and features used in any suitable section or embodiment shown in this document and other terms readily apparent from the drawings and language common or proper therefor. This document is premised upon using one or more terms or features shown in one embodiment that may also apply to or be combined with other embodiments for similar structures, functions, features and aspects of the inventions and provide additional embodiments of the inventions.

General Overview

Figure 1:
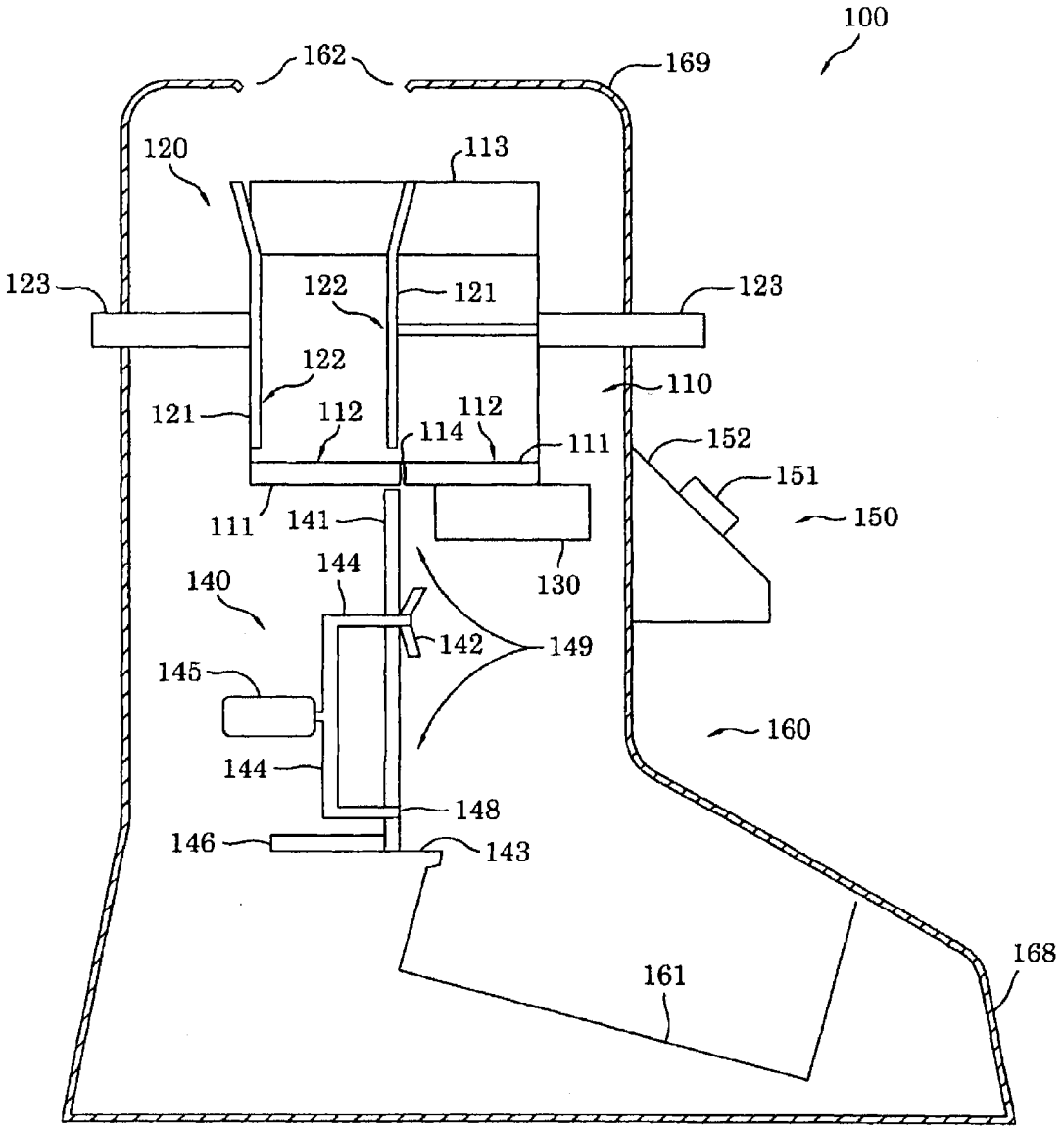
FIG. 1 is a diagrammatic elevational view of an apparatus according to at least one embodiment of the inventions.

FIG. 1 shows one preferred playing card shuffler apparatus 100 according to the inventions. The card shuffler apparatus 100 is adapted to shuffle a plurality of playing cards, which have been omitted from FIG. 1 for clarity. The apparatus is made up of several subassemblies or subsystems. As shown in FIG. 1, the sections include an entry section, wherein cards are placed into the card shuffler apparatus 100, a staging section where unshuffled cards are held, a controlled drop section through which cards that are positioned on-edge drop in a fashion preferably facilitated by vibratory action, an intermediate or medial section through which any guiding or directing of dropped cards are affected in their movement toward a collection section, wherein the dropped cards are collected and recompiled, and an egress section from which the recompiled or shuffled cards are withdrawn for use in playing the card game or games of interest.

The card shuffler apparatus 100 includes at least one card support or supporter 110, a repositioner 120 (also referred to herein as a positioner), an exciter 130, a card receiver 140, a controller 150, and a housing 160. An overview of each of these components is provided immediately below, followed by a more detailed individual description further below.

Still referring to FIG. 1, the supporter 110 functions to support the cards that are to be shuffled. More specifically, the supporter 110 supports the cards in a position substantially above the card receiver 140. The repositioner 120 functions to reposition the supported cards relative to the card receiver 140. The exciter 130 is configured to impart vibration to the supported cards. The card receiver 140 is adapted to receive one or more cards dropped from the supporter 110. Preferably, the card receiver 140 is advantageously configured to receive only one card at a time from the supporter 110. The controller 150 functions to control various operational aspects of the card shuffler apparatus 100. The housing 160 can have one or more functions including, but not limited to, that of a chassis or frame to support one or more of the other components of the card shuffler apparatus 100.

During a typical use of the card shuffler apparatus 100, at least one deck of playing cards can be placed into the housing 160 so as to rest on the supporter 110, preferably in an upstanding orientation. The repositioner 120 is activated to move the supported cards to a first randomly selected position above the card receiver 140. The exciter 130 is activated to produce a mechanical vibration. This vibration is of a frequency and amplitude sufficient to cause playing cards to "dance," or otherwise vibrate, on the supporter 110. For example, the vibration can give the cards an appearance of "floating" just above the supporter 110 or the vibration may be almost or totally unperceivable by the naked eye.

One of the playing cards that is positioned substantially directly above the card receiver 140 will preferably drop down into the card receiver 140 during operation of the card shuffler apparatus 100. When a card has dropped into the card receiver 140, the card receiver 140 is blocked so that no other cards can enter the card receiver 140. After the first card has dropped into, and is held within, the card receiver 140, the repositioner 120 shifts or moves the supported cards to a second, randomly selected position above the card receiver 140. After the supported cards are repositioned, the card receiver 140 is controlled to release the first card. For example, the card receiver 140 can be configured to help guide the card into a card collector 161. Releasing the first card from the card receiver 140 unblocks the card receiver 140. More specifically, when the first card is released from the card receiver 140, the card receiver 140 is now able to receive a second card.

Accordingly, a second card drops into the card receiver 140 from the supporter 110. The second card is held in the card receiver 140 so that the card receiver 140 is now blocked again, preventing any other cards from entering the card receiver 140. After the second card drops into the card receiver 140, the repositioner 120 is again activated to move or shift the supported cards to a third, randomly selected position substantially above the card receiver 140. The second card is then released from the card receiver 140, thus allowing a third card to drop into the card receiver 140 from the supporter 110. The second card is preferably placed onto the first card to begin forming a recompiled or shuffled array or stack of cards 20 (see FIG. 9). The third card is likewise preferably stacked on top of the second card. This operation can be continued as desired to randomly reorder the deck or decks of cards. In practice, the card shuffler apparatus 100 can be configured to repetitively perform steps of the operation very quickly.

Card Supports

As mentioned above with reference to FIG. 1, the card shuffler apparatus 100 includes a card support 110. The card support 110 preferably includes a card rest 111. The card rest 111 is adapted to support the playing cards to be shuffled in an orientation that is on-edge. The card support 110 can include a support surface 112. The support surface 112 is preferably defined on the card rest 111. Playing cards that are to be shuffled can contact the support surface 112 while being supported on the card support 110. More specifically, the cards to be shuffled can be supported on the support surface 112. The support surface 112 is preferably substantially flat and/or straight as depicted. The card shuffler apparatus 100 can be configured such that the support surface 112 is in a substantially horizontal orientation during normal operation of the card shuffler apparatus 100.

The card support 110 can include one or more edge guides 113 (also referred to herein as lateral supports 113). Preferably, the card support 110 includes a pair of edge guides 113, between which the cards to be shuffled are positioned and advantageously supported, such as at the ends laterally. The card support 110 is preferably configured to support the cards in a substantially upstanding orientation. More specifically, the card support 110 is preferably configured to support playing cards oriented on-edge. According to a preferred embodiment of the inventions, cards to be shuffled are supported in an orientation substantially normal to the support surface 112 and substantially normal to the one or more edge guides 113. It is to be understood, however, that the descriptions and depictions provided herein are not intended to limit the shape and/or orientation of one or more components of the card support 110. For example, it should be understood that the support surface 112 need not be substantially flat, and that the support surface 112 need not be substantially horizontal. The lateral face and end of support surface 112 may also vary in shape and orientation. The bottom of the support surface 112 can have at least one of a number of possible shapes, contours and/or orientations.

One or more components of the card support 110 can be designed and/or configured to have at least one resonant frequency, or a range of resonant frequencies. The resonant frequency can be selected to desirably effect imparting vibratory action to the cards supported by the card support 110. For example, a resonant frequency can be selected to enhance vibration that is produced by the exciter 130, and which is imparted to the playing cards, such as via card rest 111.

With continued reference to FIG. 1, one or more card apertures 114 is preferably defined in the card rest 111 as depicted. The one or more card apertures 114 preferably pass through the support surface 112. The card aperture 114 can be configured substantially in the manner of a slot through which at least one playing card can pass. Preferably, the card aperture 114 is configured to allow passage of only one card at a time. More specifically, the width of the card aperture 114 is greater than the thickness of a single playing card, but less than twice the thickness of a single playing card. The card aperture 114 as shown is preferably substantially straight. The card aperture 114 has a width that is preferably substantially constant along its length.

The card aperture 114 or apertures in the card rest 111 can be configured in a manner, wherein the card aperture 114 is selectively operable. Such card aperture 114 or apertures may be configured to be selectively opened and closed or blocked and unblocked according to at least one embodiment of the inventions. For example, the card rest 111 can be made up of two portions. The two portions of the card rest 111 can be made to move together to substantially close or block the card aperture 114 or apertures.

Conversely, two portions of the card rest 111 can be made to move away from each other to form a card aperture 114 or apertures. Alternatively, one or more gate elements such as described below can be included. Such a gate element or elements can be adapted to move relative to the card rest 111 so as to selectively close or block the card aperture 114.

Preferably, the card rest 111 is adapted to support playing cards until the cards are released through one or more card apertures 114. In accordance with at least one preferred embodiment of the inventions, the card rest 111 is adapted to support playing cards on-edge. For example, the card rest 111 can be adapted to support playing cards in a substantially upright or upstanding orientation. It is to be understood that when playing cards are supported on-edge by the card rest 111, the cards need not be truly vertical. For example, in accordance with at least one embodiment of the inventions, the card rest 111 is adapted to support playing cards on-edge, wherein the cards are not truly vertical. For example, the card rest 111 can be adapted to support playing cards on-edge in an oblique or leaning, non-vertical, or acceptably tilted orientation, which can vary dependent upon the specific construction of each card shuffler apparatus 100.

The card rest 111 is preferably adapted to selectively impart a vibratory action to playing cards supported on the card rest 111. In accordance with a preferred embodiment of the inventions, the card rest 111 is adapted to selectively impart a vibratory action to the playing cards while the cards are supported on-edge by the card rest 111. For example, the card rest 111 can be caused to vibrate, which in turn, can impart a vibratory action to playing cards supported thereon. Vibratory action can preferably be imparted to the card rest 111 by the exciter 130, which is described in greater detail below.

The preferred vibratory action imparted to playing cards by the card rest 111 may cause the cards to have an appearance of "dancing" or "floating" on the card rest 111 and/or support surface 112. The vibratory action is operable at a range of frequencies, such as in the order of 10 Hz to 100,000 Hz, more preferably 100 Hz to 10,000 Hz, even more preferably 1000 Hz to 10,000 Hz. The amplitude may be of varying amounts depending upon the dynamics of the card rest 111 and how it is mounted.

The vibratory action of the card rest 111 can have at least one of a number of possible types of motions or movements. For example, the card rest 111 can be caused to vibrate with a substantially random motion. Alternatively, for example, the card rest 111 can be caused to vibrate with a substantially defined or substantially repetitive motion. Vibratory motion of the card rest 111 can be of different types, such as substantially two-dimensional in nature. Alternatively, vibratory motion of the card rest 111 can be substantially three-dimensional.

Card Rest and Positioner

FIG. 1 also indicates the positioner 120 is shown as a component of the card shuffler apparatus 100. The positioner 120 functions to reposition, or move in a relative manner, the relative position of an array of upstanding playing cards relative to and supported by the card support 110. Preferably, the positioner 120 is adapted to reposition or move playing cards supported on the card rest 111. More preferably, the positioner 120 is configured to reposition or move playing cards supported on the support surface 112. The positioner 120 is preferably adapted to reposition or move supported playing cards relative to the card receiver 140, which is described in greater detail hereinbelow. Preferably, the positioner 120 is adapted to move or reposition supported playing cards relative to the card aperture 114 or slot.

The positioner 120 can include one or more positioner guides or face guides 121. The face guide 121 is adapted to contact a face of playing cards supported on the card support 110. More specifically, the face guide 121 is adapted to contact and/or engage a top side and/or bottom side or face of playing cards supported on the card support 110. According to an exemplary embodiment of the invention, the face guide 121 is substantially parallel to the playing cards supported on the card support 110. Preferably, the face guide 121 is substantially perpendicular or normal to the edge guide 113. The face guide 121 is preferably substantially perpendicular to the support surface 112. The face guide 121 can be substantially in the form of a flat plate in one form of the inventions.

The face guide 121 defines a contact surface or face 122. Preferably, the face 122 is substantially flat. The face 122 is adapted to contact a flat side of the playing cards supported on the card support 110. More specifically, the face 122 is adapted to contact and/or engage a top side and/or bottom side or face of the playing cards supported on the card support 110. According to an exemplary embodiment of the invention, the face 122 is substantially parallel to the playing cards supported on the card support 110. The face 122 is substantially perpendicular or normal to the edge guide 113, as depicted. As shown, the face guide 121 is substantially perpendicular to the support surface 112.

The positioner 120 can include a pair of face guides 121. The pair of face guides 121 is preferably maintained in juxtaposed orientation relative to each other. More preferably, the pair of face guides 121 is preferably maintained in a substantially parallel juxtaposed orientation, as shown. The pair of face guides 121 is preferably maintained in a spaced apart relationship. More specifically, each of the pair of face guides 121 is preferably located on opposing sides of playing cards supported on the card rest 111. For example, supported playing cards are preferably located between the pair of face guides 121 of positioner 120.

The spacing between the pair of face guides 121 is preferably variable. Such variable spacing between the face guides 121 can facilitate keeping supported cards in an upstanding orientation, as the number of supported cards changes. For example, as the card shuffler apparatus 100 shuffles playing cards, the number of playing cards supported on the card rest 111 will decrease. Thus, as the number of supported playing cards decreases, the face guides 121 of the positioner 120 may in controlled response, move closer to each other to compensate for the decrease in the number of supported cards.

The positioner 120 can include at least one actuator 123. The at least one actuator 123 is preferably adapted to actuate or move at least one face guide 121 of the positioner 120. According to a preferred embodiment of the inventions, the at least one actuator 123 is connected or linked to at least one face guide 121. For example, the at least one actuator 123 of the positioner 120 can be a linear actuator, as depicted. Preferably, the positioner 120 includes a pair of actuators 123 as shown. More preferably, the positioner includes a pair of face guides 121 and a pair of actuators 123, wherein each actuator 123 is exclusively associated with one of the face guides 121, as depicted. More specifically, each of the face guides 121 is individually movable or repositionable according to a preferred embodiment of the inventions. Most preferably, each of the face guides 121 is individually movable or repositionable by way of an associated actuator 123.

According to a preferred embodiment of the inventions, the face guides 121 of the positioner 120 are adapted to reposition supported playing cards by pushing and/or sliding the cards along the card rest 111 and/or the support surface 112. Such repositioning of supported cards is preferably performed while vibratory action is imparted to the cards by the exciter 130, which is described in greater detail below. The face guides 121 are adapted to reposition or move supported playing cards, as well as being adapted to move relative to each other. By moving relative to each other, the face guides 121 are able to vary the spacing between each other to account for varying numbers of supported cards.

Exciter

With continued reference to FIG. 1, the card shuffler apparatus 100 includes at least one exciter 130. The at least one exciter 130 is adapted to impart vibratory action in playing cards supported by the card support 110. Preferably, the at least one exciter 130 is adapted to impart vibratory action to playing cards supported by the card rest 111. More preferably, the at least one exciter 130 is configured to impart vibratory action to playing cards supported on the support surface 112. In accordance with at least one embodiment of the inventions, the at least one exciter 130 is adapted to impart vibratory action to the card rest 111. For example, imparting vibratory action to the card rest 111 can be accomplished in a manner wherein vibratory action is, in turn, imparted from the card rest 111 to playing cards supported thereon. Thus, according to at least one embodiment of the inventions, the at least one exciter 130 is adapted to impart vibratory action to the playing cards by imparting vibratory action to the card rest 111, which in turn imparts vibratory action to cards supported thereon.

The exciter 130 is preferably adapted to create a mechanical vibration. The vibration created by the exciter 130 can be at least one of a number of possible types of vibration. For example, the vibration created by the exciter 130 can be substantially two-dimensional in nature. Alternatively, the vibration created by the exciter 130 can be substantially three-dimensional in nature. As a further example, the vibration created by the exciter 130 can consist of substantially random vibratory motion. Alternatively, vibratory motion of the exciter 130 can be substantially regular and/or repetitive in nature. The vibratory action created by the exciter 130 can be of a relatively high frequency. The vibratory action created by the exciter 130 may be of a relatively low amplitude. Preferably, the vibratory action created by the exciter 130 is of substantially high frequency and low amplitude. More preferably, the vibratory action created by the exciter 130 is of a frequency and/or amplitude that causes supported cards to behave in a manner that is advantageous to the operation of the card shuffler apparatus 100 as described herein.

The exciter 130 is preferably connected to the card support 110. For example, the exciter 130 can be connected and/or linked with the card rest 111, as shown. The exciter 130 is preferably connected with at least a portion of the card support 110 so as to impart vibratory action from the exciter 130 to playing cards supported on the card support 110. According to the exemplary embodiment of the inventions, the exciter 130 is connected to and/or mounted directly on the card support 110. For example, the exciter 130 can be connected to and/or mounted directly on the card rest 111, as shown. According to an alternative embodiment of the inventions, the exciter 130 is substantially integrated with the card support 110.

The exciter 130 can be configured to operate according to at least one of various possible manners of creating vibratory action, both known and yet to be discovered. Such manners of creating vibratory action can include, for example, mechanical means, electrical means, and electro-mechanical means, among others. For example, one way of creating vibratory action is by employing a rotary actuator (not shown) such as a rotary motor to rotate a weight that is eccentrically positioned relative to its axis of rotation. Another example of creating vibratory action is to subject a movable ferric object (not shown) to an electro-magnetic field of dynamically alternating polarity to cause the ferric object to oscillate or vibrate. In accordance with at least one embodiment of the inventions, the frequency and/or the amplitude of the vibratory action created by the exciter 130 is selectively adjustable.

Card Receiver

Still referring to FIG. 1, the card receiver 140 is included in the card shuffler apparatus 100. The card receiver 140 is adapted to receive at least one playing card from the card support 110. Preferably, the card receiver 140 is adapted to receive only one playing card at a time. For example, the card receiver 140 can be sized and/or otherwise configured so that no more than one playing card at a time can be received into the card receiver 140. The card receiver 140 includes a slot or card space 149 into which one or more playing cards are received from the card support 110. The card space 149 of the card receiver 140 can have one of a number of possible specific configurations. The card receiver 140 is adapted to receive and hold one or more playing cards in the card space 149. In some embodiments, the card receiver 140 is adapted to selectively retain one or more received playing cards within the card space 149.

The card receiver 140 can include a card stop 143. The card stop 143 preferably defines at least a portion of the card space 149 and is within the intermediate or medial section. The handling of the dropped card or cards in the medial section can have a number of different configurations. For example, the card stop 143 can define a lower end of the card space 149. Placement or location of the card stop 143 relative to the support surface 112 can be of significance to the operation of the card shuffler apparatus 100. Specifically, the card stop 143 is preferably located to be a certain distance from the support surface 112, wherein the distance is substantially equal to either a length or a width of playing cards being shuffled. More preferably, when a playing card has been received into the card receiver 140 from the card support 110, an upper edge of the received playing card is substantially even, or flush, with the support surface 112. The significance of this aspect of the inventions becomes more clear in view of later descriptions, which follow below with respect to the operation of the card shuffler apparatus 100.

The card receiver 140 can include one or more guides. For example, the card receiver 140 can include a first guide portion 141 and a second guide portion 142. The guide portions 141, 142 can define at least part of the card slot or card space 149 into which a playing card is received from the card support 110. Preferably, the card space 149 is substantially straight as depicted. The card space 149 is preferably substantially vertical in orientation, as is also depicted. The card space 149 is preferably substantially directly below the card aperture 114. According to an exemplary embodiment of the invention depicted in FIG. 1, a playing card is dropped from the support surface 112 through the card aperture 114, and is received into the card space 149 between the first guide portion 141 and the second guide portion 142. The received playing card is preferably supported substantially upon the card stop 143 such that a bottom edge of the received card rests upon the card stop 143 and an opposite upper edge of the received card is substantially flush or even with the support surface 112.

As shown, the card receiver 140 preferably includes at least one receiver actuator 145. The at least one receiver actuator 145 can be a linear actuator such as a linear solenoid, for example. The at least one receiver actuator 145 is preferably selectively controlled. The at least one receiver actuator 145 can be adapted for selective control by the controller 150, as is described in greater detail hereinbelow. The card receiver 140 can include a link or linkage 144. The link 144 can be connected to the receiver actuator 145, as depicted. More specifically, link 144 can be operably connected to the receiver actuator 145 for selective movement of the link 144. The link can be connected to at least one portion of the receiver guides such as the second guide portion 142, as shown.

The link 144 can include a bottom guide 148. The bottom guide 148 is adapted to contact and/or engage a received playing card that is retained in the card space 149. The receiver actuator 145, along with the link 144 and bottom guide 148, can make up and/or form portions of a release mechanism. The second guide portion 142 can be included in such a release mechanism. Specifically, the receiver actuator 145, together with the link 144, bottom guide 148 and second guide portion 142, can be configured to facilitate release of a playing card retained in the card space 149. For example, according to an exemplary embodiment of the inventions, the receiver actuator 145 can be activated to move the link 144 toward the first guide portion 141.

Movement of the link 144 toward the first guide portion 141 can cause the second guide portion 142 to move away from the first guide portion 141, while at the same time causing the bottom guide 148 to push a lower end of the retained card away from the first guide portion 141 and past the card stop 143. This operation is described hereinbelow in greater detail. Such an operation of the receiver actuator 145 and the link 144 in this manner can cause release of a retained playing card from the card space 149. A playing card released from the retained position in the card receiver 140 can cause the card to fall into a card collector 161. Following release of a retained playing card, the receiver actuator 145 can be activated to return to the original position shown in FIG. 1. With the second guide portion 142 and bottom guide 148 in their original respective positions, the card receiver 140 is ready to receive another playing card from the card support 110.

The card receiver 140 can include at least one card sensor 146. The at least one card sensor 146 can be adapted to detect presence of a playing card that has dropped into the medial zone. More specifically, in accordance with the exemplary card shuffler apparatus 100 depicted in FIG. 1, the at least one card sensor 146 can be adapted to detect that a playing card is present and/or is retained within the card space 149. Such detection of a playing card retained within the card space 149 can facilitate operation of the card shuffler apparatus 100. For example, a playing card can be allowed to drop from the card support 110 and into the card space 149 of the card receiver 140.

The card sensor 146 is adapted to detect that a playing card is fully received into the medial section. The card sensor 146 can send a signal to the controller 150 in response to detecting that a playing card has been fully dropped onto the card stop 143 and received into the card space 149. When the controller 150 receives this signal from the card sensor 146, the controller 150 can, in response, activate the repositioner 120 to reposition playing cards supported by the card support 110.

Although not preferred, it is also possible that the card sensor 146 can be employed to detect the absence of any playing card or cards from the stopped medial position in card space 149. This can be accomplished by configuring the controller 150 to recognize that all cards have been shuffled when the card sensor 146 or other sensors so indicate the presence or absence of playing cards in the card space 149 or at other locations not believed to be preferable at this time.

It is noted that the card receiver 140 is depicted as being separate and distinct from the card support 110 and/or other components of the card shuffler apparatus 100. However, it is to be understood that one or more portions of the card receiver 140 can be at least substantially integral with one or more portions of the card support 110. For example, in accordance with at least one alternative embodiment of the inventions, the first guide portion 141 is integral and/or connected with the card rest 111. Similarly, the card aperture 114 can be at least partially integrated with the card receiver 140 according to at least one embodiment of the inventions.

Controller

Figure 2:
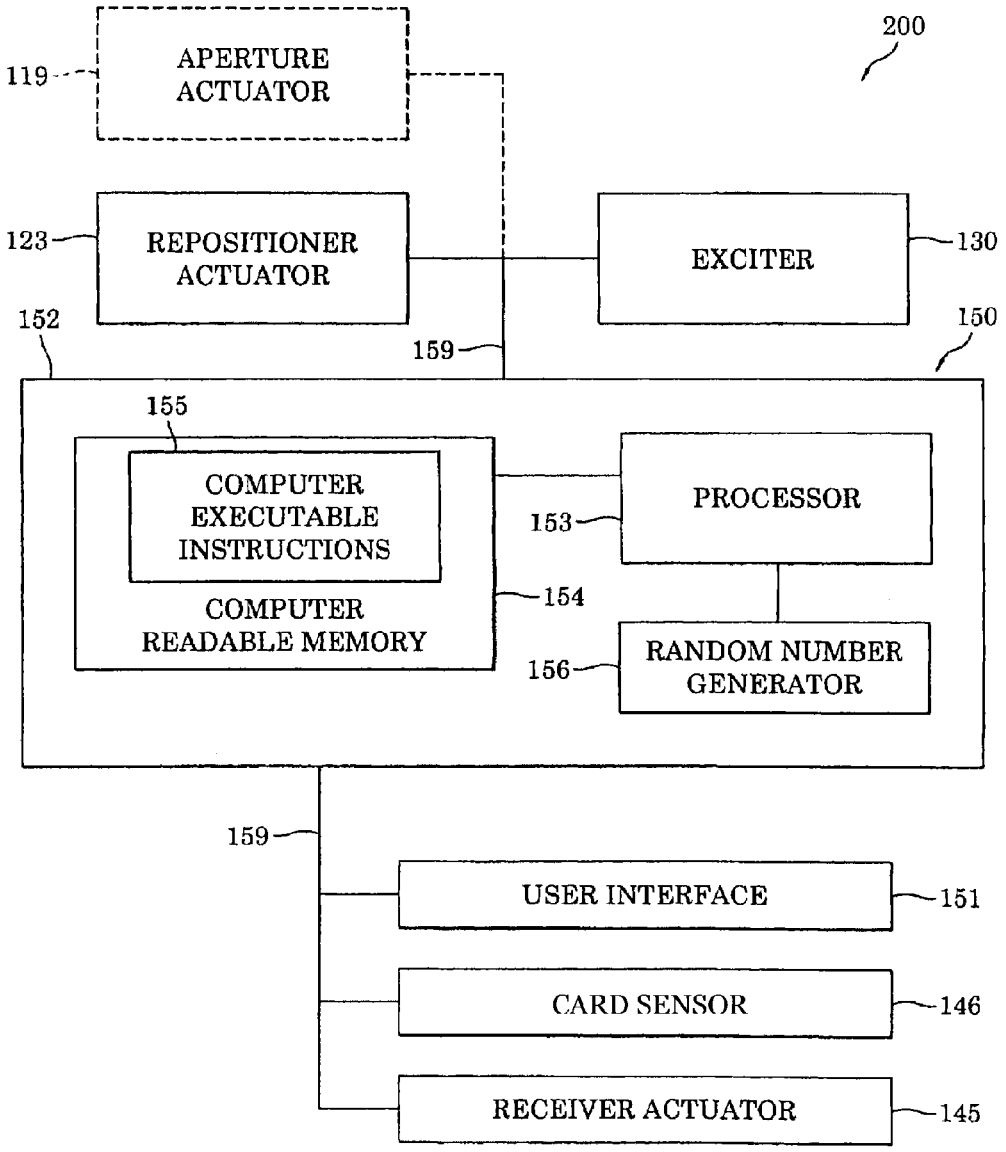
FIG. 2 is a diagrammatic view of a control system according to at least one embodiment of the inventions.

With reference now to FIGS. 1 and 2, the card shuffler apparatus 100 can include a controller 150. The controller 150 can be at least a portion of a control system 200, which can include at least one additional component, such as but not limited to, the actuator 123 of the positioner 120, the exciter 130, the receiver actuator 145, the card sensor 146, and the user interface 151. The controller 150 and/or the control system 200 is adapted to perform one or more various control functions in facilitation of operation of the card shuffler apparatus 100. Examples of various control functions that can be performed by the controller 150 and/or the control system 200 are provided further below with respect to description of operation of the card shuffler apparatus 100.

The controller 150 can be supported on or mounted to the housing 160. The controller 150 can be mounted within the housing 160 or on the exterior of the housing 160. The controller 150 can include a user interface 151. The user interface 151 is preferably configured to facilitate input of operational commands by a user of the card shuffler apparatus 100. For example, the user interface 151 can include and/or can be substantially in the form of a switch. Such a switch can be an on/off switch, a stop/start switch, or a power switch, for example. The user interface 151 can be adapted for other input commands. For example, the user interface 151 can be adapted to input and/or select optional dimensions or other characteristics of playing cards to be shuffled. Specifically, for example, the user interface 151 can be substantially in the form of a control panel having multiple command input parameters available to a user of the card shuffler apparatus 100.

In a further alternative version, the need for controls may be eliminated or simplified to a great degree. The card shuffler apparatus 100 may be constructed so as to sense when a card array is input and then merely automatically perform the shuffling process as a result of a sensor that detects cards placed within the input supports.

The controller 150 can include an enclosure 152. The user interface 151 can be mounted on, or supported by, the enclosure 152. A processor 153 is preferably included as part of the controller 150. The processor 153 can be a digital processor such as a microprocessor, or the like. The processor 153 is preferably contained within the enclosure 152. The controller 150 preferably includes a computer readable memory 154. The computer readable memory 154 is preferably housed within the enclosure 152. The processor 153 and the computer readable memory 154 are preferably linked for signal transmission. More specifically, the processor 153 is preferably able to read data and/or computer executable instructions 155 from the computer readable memory 154. According to at least one embodiment of the inventions, the processor 153 is able to write or store data in the computer readable memory 154. The controller 150 can include a random number generator 156. The random number generator 156 can be adapted to facilitate generation of random positions of the supported playing cards, as is described in greater detail hereinbelow. The random number generator 156 can be integral with the processor 153 and/or the computer executable instructions 155.

The controller 150 can be linked for signal transmission to one or more components of the card shuffler apparatus 100. More specifically, the control system 200 and/or the card shuffler apparatus 100 can include at least one communication link 159 adapted to facilitate signal transmission between the controller 150 and other components of the card shuffler apparatus 100 and/or control system 200. For example, the controller 150 can be linked for signal transmission with one or more of the positioner actuators 123, the exciter 130, the receiver actuator 145 and the card sensor 146. The controller 150 can be linked for signal transmission with an optional aperture actuator 119 that is shown by dashed lines in FIG. 2. According to an alternative embodiment of the inventions, the card shuffler apparatus 100 and/or the control system 200 can include the aperture actuator 119 to selectively open and close (or block and unblock) at least one card aperture 114 (shown in FIG. 1). The controller 150 can include various electrical and/or electronic components that are not shown, such as, but not limited to, relays, timers, counters, indicators, switches, sensors and electrical power sources.

The controller 150 is preferably adapted to facilitate operation and/or function of one or more components to which it is linked for signal transmission. For example, the controller 150 can be adapted to send on and off signals to the exciter 130. The controller 150 can be adapted to send control signals to at least one actuator including, but not limited to, one or more positioner actuators 123, receiver actuators 145, and optional aperture actuators 119 (shown by dashed lines in FIG. 2). For example, the controller 150 is preferably adapted to control positioning and/or activation of one or more actuators 123, 145. The controller 150 is preferably configured to receive and/or process input commands and/or data from the user interface 151. Preferably, the controller 150 is adapted to receive and/or process signals generated by the card sensor 146. The controller 150 is preferably adapted to generate and/or determine random positions of the supported cards, and to command the positioner 120 to move the supported cards to the randomly generated positions.

Housing

With reference to FIG. 1, the card shuffler apparatus 100 includes at least one housing 160. The housing 160 can function as a chassis or frame for one or more additional components of the card shuffler apparatus 100. More specifically, one or more components of the card shuffler apparatus 100 can be mounted on, or supported by, the housing 160. For example, the housing 160 is preferably adapted to support one or more of the card support 110, the positioner or repositioner 120, the exciter 130, the card receiver 140, and the controller 150. The housing 160 can be adapted to function as an enclosure for one or more components of the card shuffler apparatus 100, wherein the housing 160 is adapted to substantially protect enclosed components from damage and/or contamination. More specifically, one or more components of the card shuffler apparatus 100 can be enclosed within the housing 160 to decrease likelihood of damage and/or contamination. For example, the housing 160 is preferably adapted to enclose one or more of the card support 110, the positioner 120, the exciter 130, the card receiver 140, and the controller 150.

The housing 160 can include one or more features to facilitate operation and/or use of the card shuffler apparatus 100. For example, the housing 160 can include a card collector 161. The card collector 161 is preferably adapted to catch and/or collect playing cards released from the card receiver 140. The card collector 161 can be configured to form a stack of collected playing cards. For example, the card collector 161 can be sloped or tilted to facilitate collection of playing cards into a substantially orderly stack. According to at least one embodiment of the inventions, the card collector 161 is adapted to vibrate. Such vibration of the card collector 161 can facilitate collection of playing cards and/or formation of an orderly stack of collected and shuffled playing cards. For example, the exciter 130 can be configured to impart vibratory action to the card collector 161.

The housing 160 can have at least one opening 162. The at least one opening 162 can serve one or more of a number of possible uses or purposes. For example, the at least one opening 162 can be adapted to provide for placing a deck of cards into the card support 110. The housing 160 preferably has at least one other opening (not shown) proximate the card collector 161 to facilitate retrieval of the shuffled cards from the card collector 161. Still other openings (not shown) in the housing 160 can be provided for one or more of a number of purposes. For example, at least one opening (not shown) can be provided in the housing 160 to facilitate access to one or more components for repair and/or maintenance.

The housing 160 has a lower end 168 and an opposite, upper end 169. The lower end 168 preferably includes and/or forms a base for contacting or engaging a support surface such as a tabletop, counter top or shelf (not shown). Preferably, the at least one opening 162 is positioned near the upper end 169, as shown, to facilitate placement of playing cards into the card support 110. The card support 110 is preferably proximate the upper end 169. The card collector 161 is preferably proximate the lower end 168. The card receiver 140 is preferably situated substantially between the card support 110 and the card collector 161, as depicted. According to at least one preferred embodiment of the inventions, the housing 160 is configured so that the support surface 112 is substantially horizontal under normal operating conditions, as shown.

Alternative Support Biasing of Unshuffled Card Array

Figure 11:
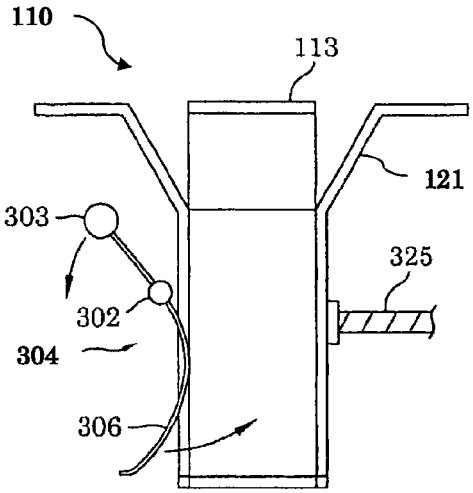
FIG. 11 is a side diagrammatic elevational view of an alternative means for biasing a card array.
Figure 12:
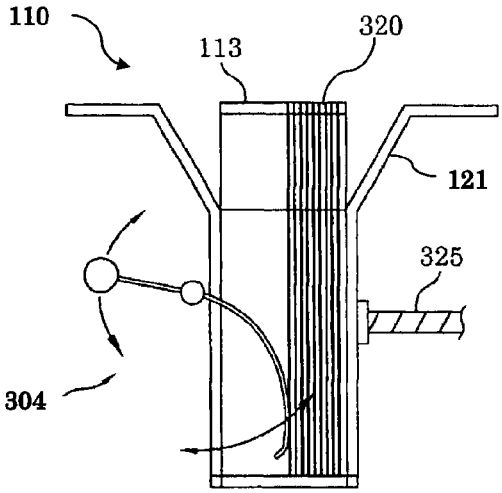
FIG. 12 is a side diagrammatic elevational view of the mechanism of FIG. 11 with playing cards shown.

FIGS. 11 and 12 show an alternative mechanism for biasing the array of upstanding cards. The card support or supporter 110 is fitted with one or more gravity biasing mechanisms 304. As shown, biasing mechanism 304 has a pivot 302. A counterbalancing weight 303 is forced downward by gravity to swing a contact arm 306 against the upstanding unshuffled card array 320.

The contact arm 306 is advantageously formed in a convex shape as seen from the array of cards 320. This minimizes any potential wear or marking of the cards. It also applies a relatively light force automatically without precise control of a stepper motor. However, precise control may not be necessary since friction between the cards is minimal and sufficiently low to allow individual cards to drop through the card aperture 114 without sufficient impedance such that dropping due to gravity occurs. The vibratory action of the unshuffled card array 320 further reduces any impedance against dropping since the coefficient of friction is typically lower in a dynamic or moving relationship versus the static coefficient of friction. Thus, one advantage of the preferred shufflers is that the vibratory action has the cards effectively "floating," due to the vibratory excitation of the unshuffled card array 320.

Figure 13:
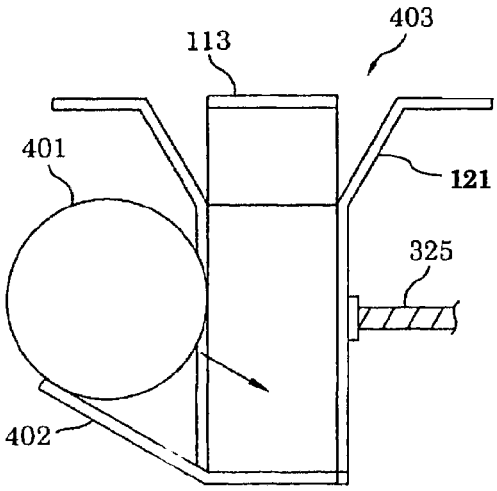
FIG. 13 is a side diagrammatic elevational view of a further alternative mechanism for biasing the array of playing cards.
Figure 14:
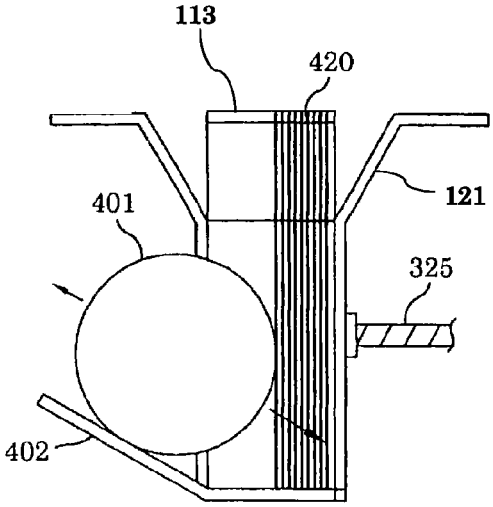
FIG. 14 is a side diagrammatic elevational view similar to FIG. 13 with an array of playing cards therein.

FIGS. 13 and 14 show a further alternative means for biasing an unshuffled card array 420. The means shown in these figures includes a ball 401. Ball 401 is positioned on a lateral guide 402, which is sloped toward an unshuffled card input support chamber 403. As illustrated in FIG. 14, the ball 401 is biased or forced by gravity to apply a lateral component of force to the unshuffled card array 420. A relatively small amount of force is currently preferred, such as a small ball of light weight. One possible form is a ping-pong ball or other small ball or other shape that can urge the unshuffled card array 420 using gravity, a spring (not shown), or other suitable biasing means that apply a relatively small amount of force to keep the unshuffled card array 420 in a sufficiently upstanding orientation to facilitate dropping through the card aperture 114 and into the medial zone of the card shuffler apparatus 100.

Alternative Embodiment

Gated Unshuffled Array Gated Support

Figure 15:
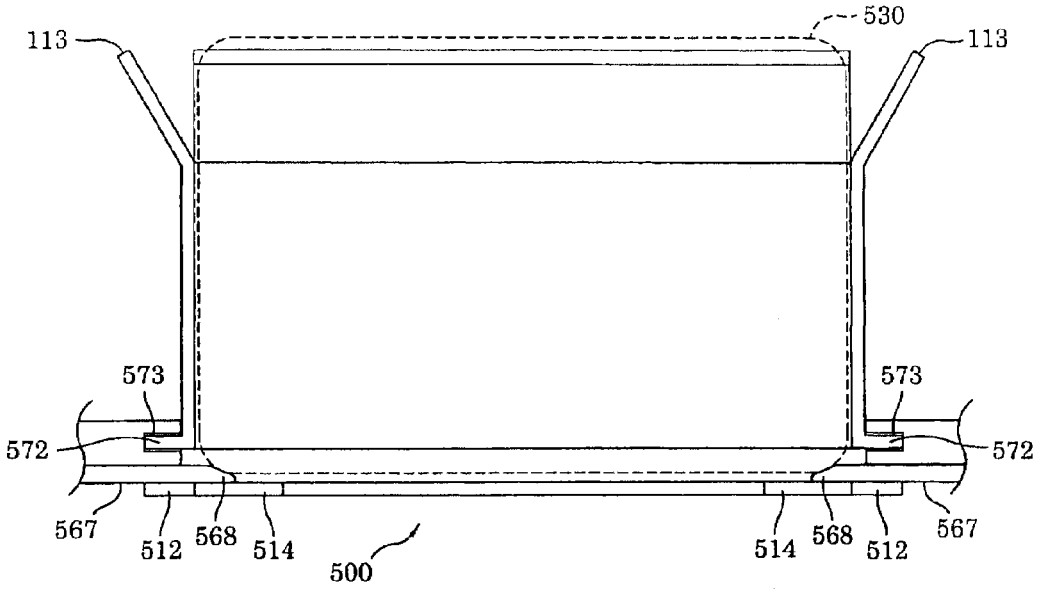
FIG. 15 is a diagrammatic elevational view showing another alternative construction for intermittently supporting the array of playing cards.
Figure 16:
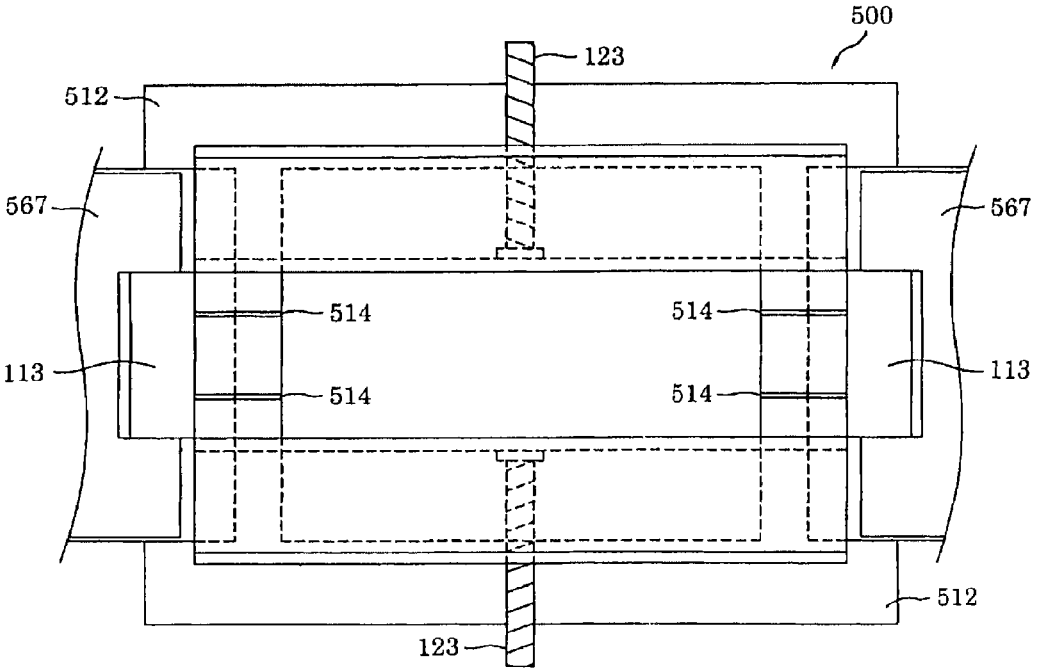
FIG. 16 is a top view of the subject matter shown in FIG. 15.

FIGS. 15 and 16 show pertinent features of a further embodiment of a card-shuffling machine 500 according to the inventions hereof. FIG. 15 shows an unshuffled card array 530 in phantom. The unshuffled card array 530 is supported alternatively by a card rest 512 and movable gates or gate pieces 567 on opposing sides (ends of cards as shown).

The card-shuffling machine 500 has lateral supports 113, which may also be referred to as edge guides, that may be provided with flanges 572, which can be constructed to slide within support channels 573. This construction allows the lateral supports 113 to move with the unshuffled card array 530. The relative motion may in fact involve motion of the lateral supports 113 and cards, the cards relative to the lateral supports 113 or both the lateral supports 113 and cards to move relative to a fixed reference point and relative to the card slot or slots 514.

The card rest 512 is as shown provided with two card slots 514 formed in each card rest or rests 512. A pair of gate pieces 567 is mounted to slide inwardly and outwardly upon the card rests 512 using actuators (not shown but similar to actuator 123 or suitable alternatives thereof). When the gate pieces 567 are controlled to slide inwardly, the rounded corners of the playing cards on the bottom are engaged and supported on the gate pieces 567, thus preventing them from dropping through slots 514. Thus the unshuffled card array 530 may be lifted slightly and relative motion between the unshuffled card array 530 and slots 514 is performed and then the gate pieces 567 are opened by moving them outwardly and cards may then drop through the slots 514.

This construction may be controlled or configured so that the gating action occurs independently for each slot 514 relative to the other slot 514. Furthermore, the cards can be simultaneously dropped and the guiding parts contained in the medial section of the card-shuffling machine 500 may appropriately accommodate the recompiling of the cards.

Operation

Figure 3:
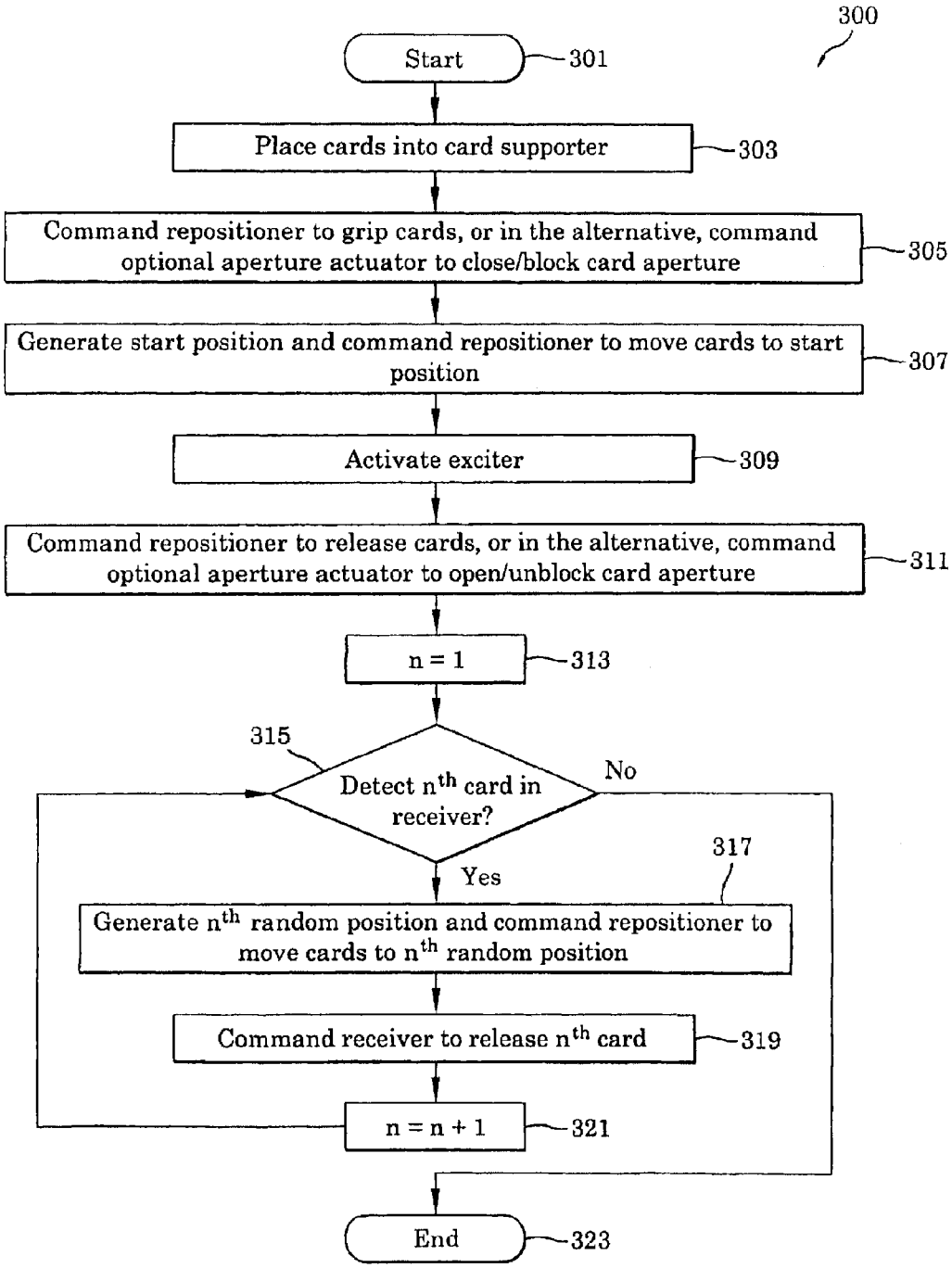
FIG. 3 is a flow diagram depicting an operational sequence according to at least one embodiment of the inventions.

With reference now to FIG. 3, a flow diagram depicts a sequence 300 of operational steps that can be carried out by one or more components of the card shuffler apparatus 100 according to at least one embodiment of the inventions. With reference to FIGS. 1-3, the sequence 300 moves from a starting point 301 to step 303, wherein a plurality of playing cards is placed onto the card support 110. The step of placing the cards into the card shuffler apparatus 100 according to step 303 can be accomplished by a user of the card shuffler apparatus 100. The starting point 301 can include turning the apparatus on, or initializing the card shuffler apparatus 100. This can be accomplished by the user. For example, the user can turn the card shuffler apparatus 100 on or initialize the apparatus by manipulating the user interface 151.

The next step 305 is to command the positioner 120 to grip the supported cards. In accordance with an alternative embodiment of the inventions, an optional aperture actuator 119 (shown by dashed lines in FIG. 2) is commanded to close or block the card aperture 114 (shown in FIG. 1). This step of generating and transmitting command signals can be carried out by the controller 150. From step 305, the sequence 300 moves to a step 307 that includes generating a start position of the supported cards relative to the card aperture 114, and commanding the positioner 120 to move the supported cards to the start position. The start position is preferably randomly determined. This step of generating the start position and commanding the positioner 120 to move the supported cards can be accomplished by the controller 150.

The sequence 300 moves next to a step 309 of activating the exciter 130. More specifically, the exciter 130 is turned on or operated so as to impart vibrational action to the supported cards. The step 309 of activating the exciter 130 can be carried out by the controller 150. The step 309 of activating the exciter 130 can have other alternative positions in the sequence 300. For example, the step of activating the exciter 130 can be the first step of the sequence 300. Once the exciter 130 is turned on, the sequence 300 moves to a step 311 of commanding the positioner 120 to release the supported cards. In accordance with an alternative embodiment of the inventions, the optional aperture actuator 119 (shown by dashed lines in FIG. 2) is commanded to open/unblock the card aperture 114 (shown in FIG. 1). This step 311 can be performed by the controller 150. From step 311, the sequence 300 moves to step 313 during which a counter is initialized to unity. More specifically, for example, a variable "n" is set to a value of "1" according to this step, which can be accomplished by the controller 150.

From the step 313, the operational sequence 300 moves to a query 315. The query 315 asks whether the $n^{th}$ card is detected in the card receiver 140. More specifically, the query 315 asks whether the $n^{th}$ card has dropped into a fully received position within the card receiver 140. This query 315 can be performed by the controller 150 in conjunction with the card sensor 146. For example, the card sensor 146 looks for a card to drop into a fully received position within the card space 149. When the card sensor 146 detects the presence of the card, the card sensor 146 transmits a signal to the controller 150 by way of the respective communication link 159. The controller 150 receives the signal from the card sensor 146 as indication that the $n^{th}$ card has been fully received into the card receiver 140.

If the answer to the query 315 is "yes," then the sequence 300 proceeds to a step 317, wherein the $n^{th}$ position is randomly generated and the positioner 120 is commanded to move the supported cards to the $n^{th}$ random position. This step 317 can be performed by the controller 150, for example. From this step, the sequence 300 moves to a step 319, in accordance with which the card receiver 140 is commanded to release the $n^{th}$ card. For example, the $n^{th}$ card is released from a retained position in the card space 149, and is allowed to drop into the card collector 161. This step of commanding the card receiver 140 to release the $n^{th}$ card can be performed by the controller 150, for example. From the step 319, the sequence 300 proceeds to a step 321, wherein the counter is incrementally increased to the next value. Specifically, the value of the variable "n" is increased by a value of one.

From the step 321, the sequence 300 returns to the query 315 described above. As is described above, if the answer to the query 315 is "yes," then the steps 317, 319 and 321 are repeated. For example, the steps 317, 319 and 321 of generating the $n^{th}$ random position for the supported cards, moving the supported cards to the $n^{th}$ random position, releasing the $n^{th}$ card from the card receiver 140, and incrementing the counter, continue as long as the card sensor 146 continues to detect the $n^{th}$ card being fully received into a retained position within the card space 149. However, if the answer to the query 315 is "no," then the sequence 300 proceeds to end point 323. For example, if the controller 150 does not receive a signal from the card sensor 146 for a predetermined period of time (i.e., the card sensor 146 fails to detect the presence of a card being fully received into a retained position within the card space 149), then the controller 150 will assume that there are no additional cards to process, and the controller 150 will end the operational sequence 300.

Figure 4:
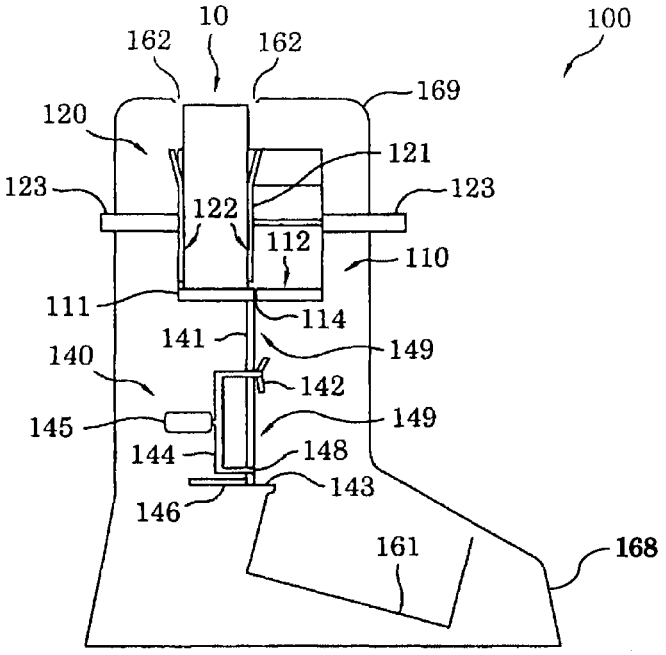
FIG. 4 is a side diagrammatic elevational view depicting one of a series of operational steps of an apparatus according to at least one embodiment of the inventions.

Referring now to FIGS. 4-9, a series of elevational views of the card shuffler apparatus 100 illustrates an operational sequence according to at least one embodiment of the inventions. With reference to FIG. 4, the card shuffler apparatus 100 is shown in a card loading mode or status. With the apparatus in the loading mode, the face guides 121 are positioned to receive a deck of cards 10 through the loading opening 162. As shown, the plurality of cards 10 to be shuffled has been inserted through the loading opening 162 and has been set on the card support 110. More specifically, the plurality of cards 10 to be shuffled has been placed on the support surface 112. According to an exemplary embodiment of the inventions, when the card shuffler apparatus 100 is in the loading mode, the cards 10 to be shuffled are not above the card aperture 114. More specifically, when in the loading mode the face guides 121 are offset relative to the card aperture 114, as shown, so that the card aperture 114 is not below the supported cards 10.

Still referring to FIG. 4, the receiver actuator 145 is in a deactivated status. More specifically, the receiver actuator 145 is in a position, wherein the link 144 is in a withdrawn position. With the link 144 in a withdrawn position, the bottom guide 148 is also withdrawn, as shown. The second guide portion 142 is in a card retention position, wherein the first guide portion 141 and the second guide portion 142 together, are configured to receive a card into the card space 149. Cards to be shuffled can be loaded by insertion of the cards through the loading opening 162 and placement of the cards onto the support surface 112. A user of the card shuffler apparatus 100 can start the operational sequence 300 (FIG. 3) of the card shuffler apparatus 100 after the cards are loaded into the card shuffler apparatus 100. Commencement of the operational sequence 300 can be effected by manipulation of the user interface 151, for example.

In response to commencement of the operational sequence 300, the face guides 121 are activated to grip the supported cards 10. Gripping of the supported cards 10 by the face guides 121 can be accomplished, for example, by causing the positioner actuators 123 to cause the face guides 121 to move and/or exert a force toward each other, thereby squeezing or trapping the cards therebetween. The exciter 130 is activated in response to commencement of the operational sequence. Activation of the exciter 130 preferably causes the exciter 130 to impart vibratory action to the supported cards 10. For example, as described above, the exciter 130 can be adapted to impart vibratory action to one or more components of the card shuffler apparatus 100, such as the card support 110. In response to commencement of the operational sequence 300, the controller 150 (FIGS. 1 and 2) can define a starting position of the cards 10 relative to the card aperture 114. This starting position of the cards 10 is preferably randomly selected or generated. The controller 150 can then command the positioner actuator 123 to cause the face guides 121 to move the cards 10 to the starting position, while also maintaining a grip on the cards.

Figure 5:
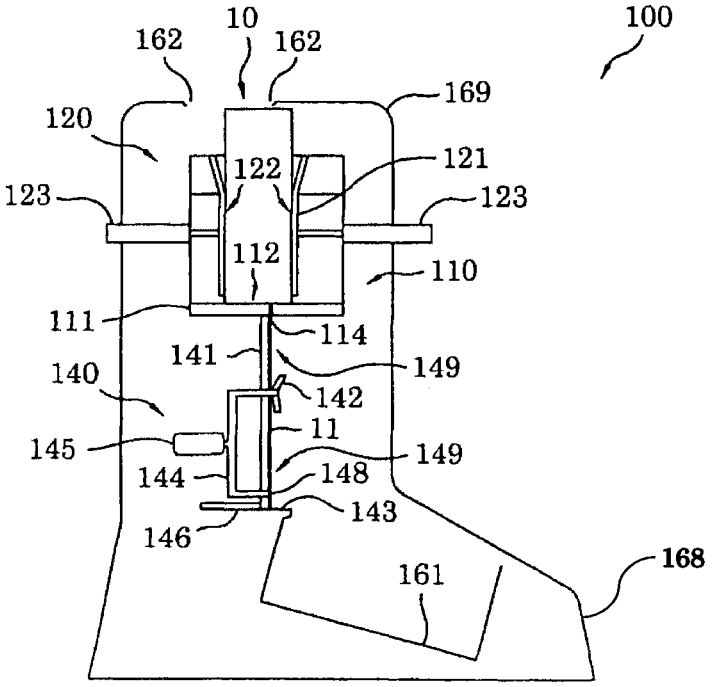
FIG. 5 is a side diagrammatic elevational view depicting one of a series of operational steps of an apparatus according to at least one embodiment of the inventions.

With reference now to FIG. 5, it is seen that the cards 10 have been moved to the starting position. The starting position places the cards 10 above the card aperture 114. More specifically, when the cards 10 are in the starting position, the cards 10 are situated substantially above the card space 149. After the cards 10 have been moved to the start position, the positioner 120 preferably transmits a signal to the controller 150 to indicate that the movement is complete. The controller 150 then preferably commands the positioner 120 to release its grip on the cards 10. This can be accomplished, for example, by commanding one or more of the positioner actuators 123 to move the face guides 121 away from each other so that substantially little force is exerted on the cards 10 by the face guides 121.

When the cards 10 are released by the positioner 120, the cards 10 will come to rest substantially on the support surface 112. Preferably, vibrational action of the support surface 112 will be imparted to the cards 10 supported thereon. Vibrational action is preferably imparted to the support surface 112 by the exciter 130 (FIG. 1) Impartation of vibrational action to the supported cards 10 will preferably result in a first card 11 dropping from the support surface 112 through the card aperture 114 into a retained position within the card space 149, as shown. After dropping through the card aperture 114 and into the card space 149, a lower edge of the first card 11 comes to rest substantially on the card stop 143. When the first card 11 is resting substantially upon the card stop 143, the first card 11 has been substantially completely dropped and received into the medial card space 149.

With a lower edge of the first card 11 resting substantially on the card stop 143, an opposite, upper edge of the first card 11 is substantially flush or even with the support surface 112, as shown. With an upper edge of the first card 11 being substantially even or flush with the support surface 112, the card receiver 140 and/or the card aperture 114 is substantially blocked or closed so that no other cards can enter the card receiver 140. The card sensor 146 preferably detects that the first card 11 has dropped into a fully received position within the card space 149. In response to detecting presence of the first card 11, the card sensor 146 transmits a signal to the controller 150. The controller 150 receives the signal from the card sensor 146 and interprets the signal to indicate that the first card 11 has been fully received into the medial card space 149. In response to recognizing that the first card 11 has been received into the card space 149, the controller 150 randomly selects or generates a new position of the supported cards 10 relative to the card aperture 114. The controller 150 can then command the positioner 120 to move the supported cards 10 to a new randomly selected position.

Figure 6:
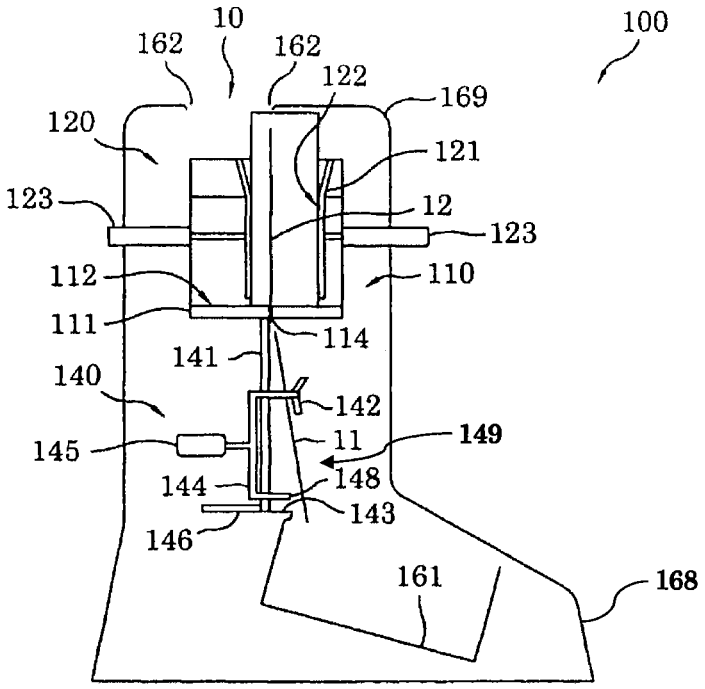
FIG. 6 is a side diagrammatic elevational view depicting one of a series of operational steps of an apparatus according to at least one embodiment of the inventions.

Turning now to FIG. 6, it is seen that the supported cards 10 have been moved to the new, randomly selected position relative to the card aperture 114. The positioner 120 preferably transmits a signal to the controller 150 to indicate that movement of the cards 10 to the new, randomly selected position is complete. The controller 150 then commands the receiver actuator 145 to activate. Activation of the receiver actuator 145 causes the first card 11 to be released and directed or guided from the card space 149, as shown. The first card 11 preferably drops from the card receiver 140 into the card collector 161.

In some preferred versions of the invention, the dropping of first card 11 from the card rest 111 into the card receiver 140 causes the card aperture 114 to be opened or unblocked. With the card aperture 114 unblocked, and as a result of vibrational action of the supported cards 10, a second card 12 begins dropping through the card aperture 114 and into the card space 149 as shown. Card sensor 146 can advantageously detect the first card 11 positioned in the card space 149, and transmit a signal to the controller 150 indicating that the first card 11 is in the stopped position waiting to be directed or released or otherwise guided from the medial card space 149 and into the card collector 161.

Figure 7:
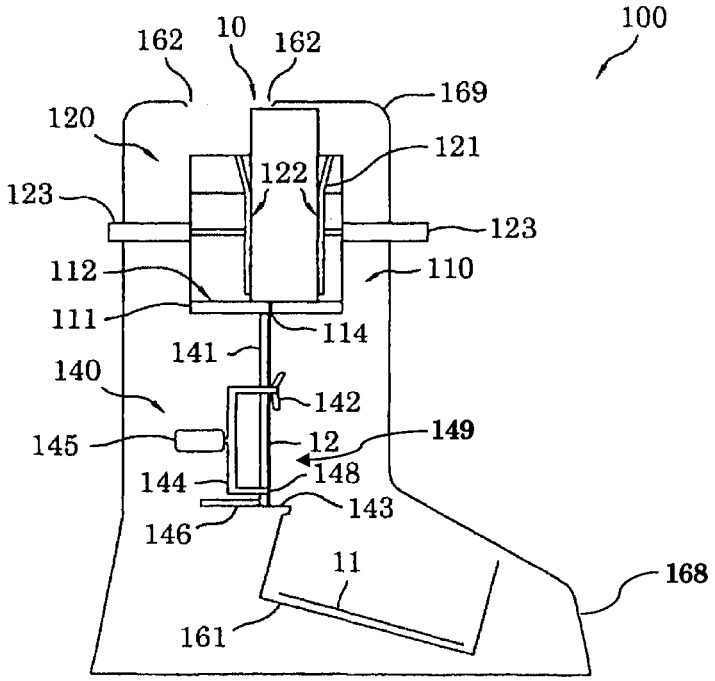
FIG. 7 is a side diagrammatic elevational view depicting one of a series of operational steps of an apparatus according to at least one embodiment of the inventions.

Turning now to FIG. 7, it is seen that the second card 12 has been fully received into the card receiver 140. More specifically, it is seen from a study of FIG. 7 that the second card 12 has dropped through the card aperture 114, and a lower edge of the second card 12 has come to rest substantially on the card stop 143. With a lower edge of the second card 12 resting substantially on the card stop 143, an opposite, upper edge of the second card 12 is substantially flush or even with the support surface 112. With an upper edge of the second card 12 being substantially flush or even with the support surface 112, it is seen that the card aperture 114 is substantially blocked or closed by the second card 12. More specifically, with the second card 12 being in a fully retained position within the card receiver 140, the card receiver 140 is blocked so that no additional cards can drop and enter into the medial card space 149.

Further study of FIG. 7 shows that the first card 11 has come to rest within the card collector 161 after having been released from the card receiver 140. The card sensor 146 preferably detects that the second card 12 has dropped into a fully received position within the card space 149. In response to detecting presence of the second card 12, the card sensor 146 transmits a signal to the controller 150. The controller 150 receives the signal from the card sensor 146 and interprets the signal to indicate that the second card 12 has been fully received into the card space 149. In response to recognizing that the second card 12 has been received into the card space 149, the controller 150 randomly selects or generates a new position of the supported cards 10 relative to the card aperture 114. The controller 150 can then command the positioner 120 to move the supported cards 10 to the new, randomly selected position.

Figure 8:
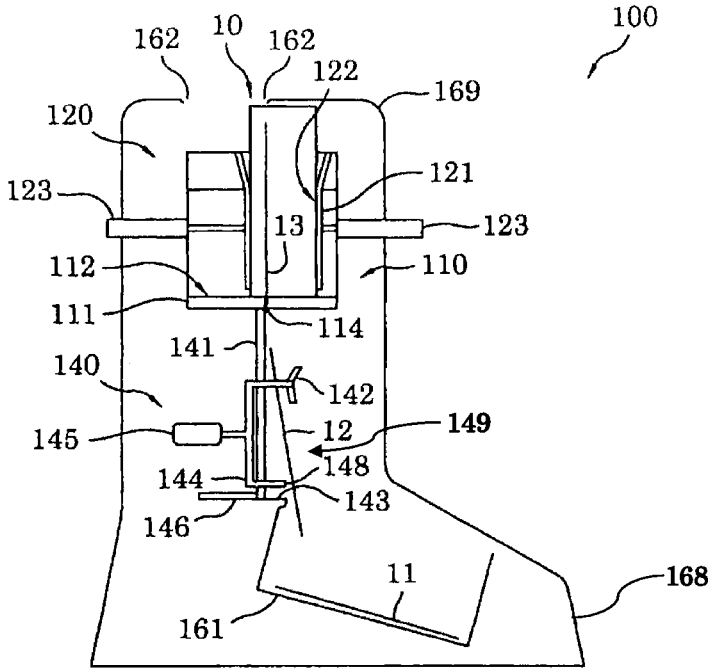
FIG. 8 is a side diagrammatic elevational view depicting one of a series of operational steps of an apparatus according to at least one embodiment of the inventions.

With reference now to FIG. 8, it is seen that the supported cards 10 have been moved to the new, randomly selected position relative to the card aperture 114. The positioner 120 preferably transmits a signal to the controller 150 to indicate that movement of the cards 10 to the new, randomly selected position is complete. The controller 150 then commands the receiver actuator 145 to activate. Activation of the receiver actuator 145 causes the second card 12 to be released from the card space 149, as shown. The second card 12 preferably drops from the card receiver 140 into the card collector 161. Release of the second card 12 from the card receiver 140 causes the card aperture 114 to be opened or unblocked. With the card aperture 114 unblocked, and as a result of vibrational action of the supported cards 10, a third card 13 begins dropping through the card aperture 114 and into the card space 149, as shown. The operational sequence described hereinabove can be continued as desired to shuffle a desired number of playing cards.

Figure 9:
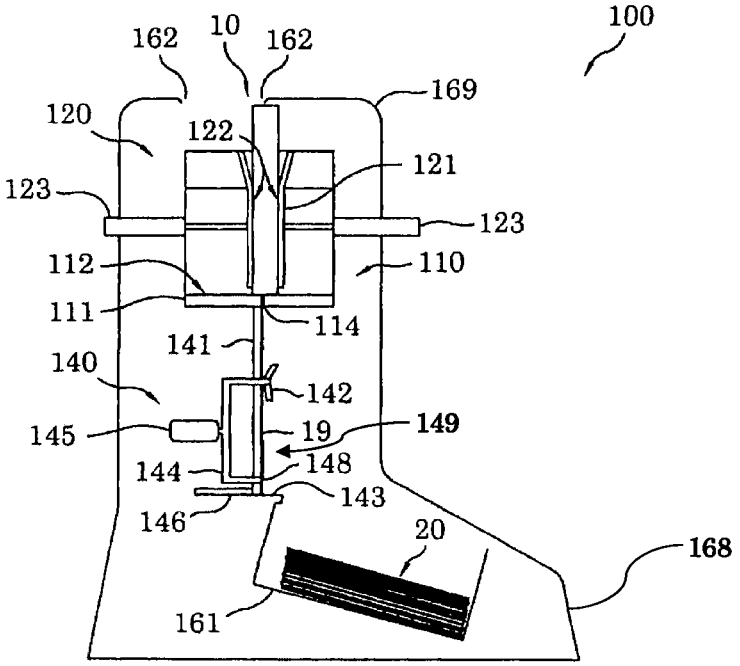
FIG. 9 is a side diagrammatic elevational view depicting one of a series of operational steps of an apparatus according to at least one embodiment of the inventions.

Turning now to FIG. 9, it is seen that the above-described operational sequence has continued to produce a stack of shuffled cards 20, which are held in the card collector 161. The operational sequence 300 (FIG. 3) continues with a retained card 19 shown in a fully received position in the card space 149, and a plurality of supported cards 10 remaining to be shuffled. It is seen that the quantity of supported cards 10 has been depleted as the result of continuation of the operational sequence 300 of the card shuffler apparatus 100. It can also be seen that the face guides 121 have been repositioned relative to each other. Specifically, the face guides 121 have moved closer to each other in response to depletion of the quantity of supported cards 10. In this manner, the positioner 120 facilitates maintaining the supported cards 10 in a substantially upstanding orientation. Continued processing of the supported cards according to the operational sequence 300 results in deposition of all cards in the card collector 161. More specifically, upon completion of processing of all cards according to the operational sequence 300, the shuffled cards can be retrieved from the card collector 161.

Alternative Aspects and Configurations

Figure 10:
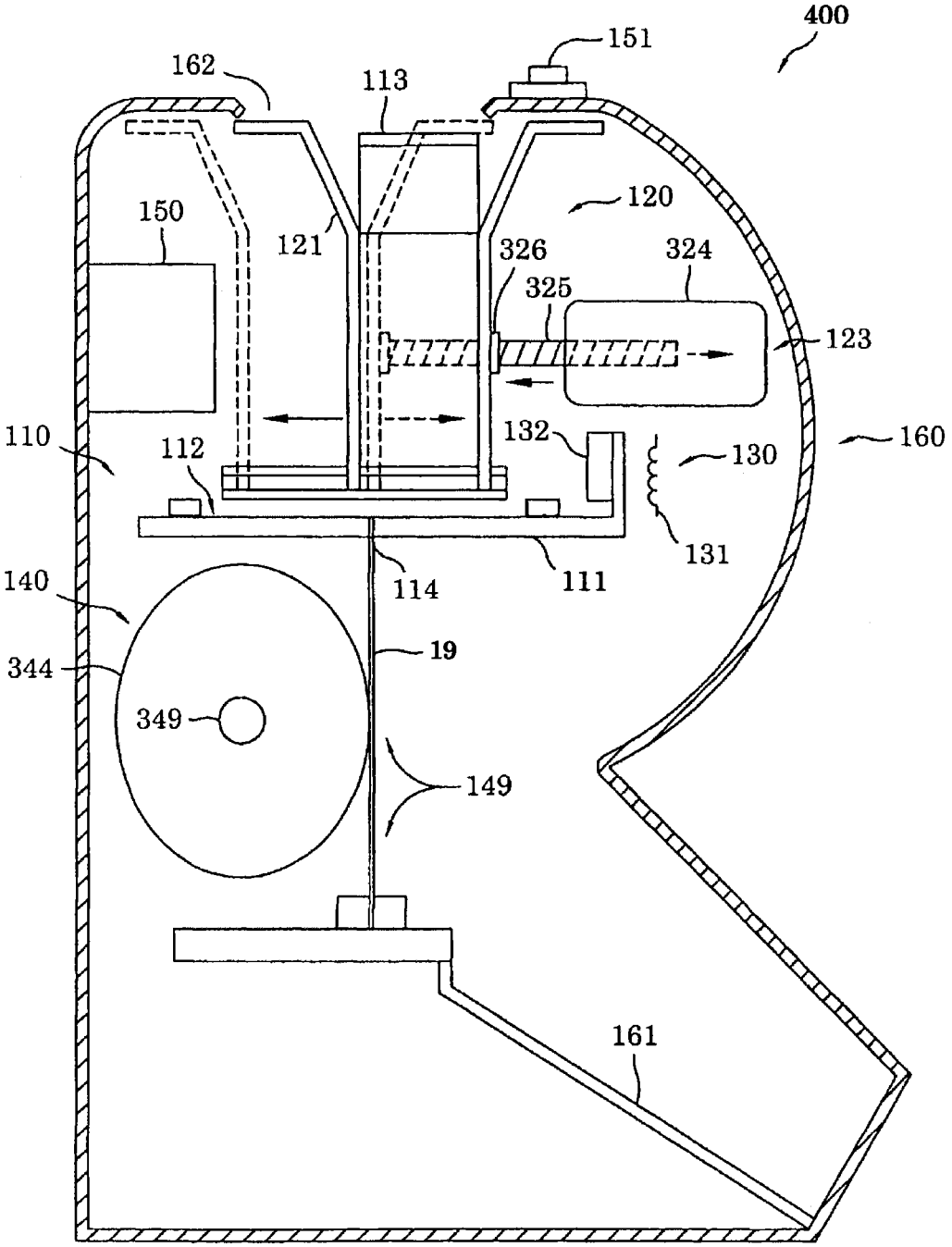
FIG. 10 is a side diagrammatic elevational view of an apparatus according to another embodiment of the inventions.

Turning now to FIG. 10, an elevational view shows an apparatus 400 according to another embodiment of the inventions. The apparatus 400 preferably functions in a manner substantially similar to that of the card shuffler apparatus 100. However, the apparatus 400 includes alternative aspects and/or configurations of various components. For example, from a study of FIG. 10, it is seen that the user interface 151 can be mounted in a location relative to the housing 160, which is different from that of the card shuffler apparatus 100 (shown in FIG. 1). The face guides 121 of the apparatus 400 can have a shape that is different from those of the card shuffler apparatus 100. For example, the face guides 121 of the apparatus 400 can be configured to overlap the loading opening 162, as is shown in FIG. 10. As a further example, the controller 150 can be located substantially within the housing 160, as shown in FIG. 10.

With continued reference to FIG. 10, the positioner 120 can include a rotary actuator or motor 324, a lead screw 325 and a connector or follower 326. The rotary actuator 324 can be, for example, a rotary electric motor such as a stepper motor, or the like. The rotary actuator 324 is preferably fixedly supported by the housing 160. The motor 324 is configured to selectively drive or rotate the lead screw 325. Activation of the motor 324 is preferably controlled by the controller 150. The connector 326 is engaged with the externally threaded lead screw 325. A follower 326 forming part of the rotary actuator 324 is connected causing the lead screw 325 to extend and retract the face guides 121. The motor 324 can be selectively activated to rotate in a desired direction, which in turn, causes the lead screw 325 to rotate. Rotation of the lead screw 325 relative to the follower 326 causes the follower 326 and one or more of the face guides 121 to move relative to the motor 324. In this manner, the face guides 121 can be positionally controlled.

The exciter 130 can include a coil 131 and vibrational follower 132. The vibrational follower 132 is preferably ferro-magnetic. The coil 131 can be mounted on or supported by the housing 160. The vibrational follower 132 can be mounted on or supported by the card rest 111. The vibrational follower 132 can be substantially integral with the card rest 111. The coil 131 can be subjected to intermittent direct current of a given polarity to cause vibrational movement of the vibrational follower 132. Alternatively, the coil 131 can be subjected to current of alternating polarity to cause vibrational movement of the vibrational follower 132. Such vibrational movement of the vibrational follower 132 is preferably imparted to the card rest 111, which in turn, imparts vibrational action to playing cards supported thereon.

With continued reference to FIG. 10, the card receiver 140 can have a configuration that is substantially different from that of the card shuffler apparatus 100 shown in FIG. 1. For example, as shown in FIG. 10, the card receiver 140 can include a cam lobe element 344. The cam lobe element 344 can have a cross-sectional shape, substantially in the form of an ellipse, as shown. The cam lobe element 344 can be rotationally supported by a shaft 349. The shaft 349 is preferably rotatably supported by the housing 160. The shaft 349 is preferably positioned in a manner to place the cam lobe element 344 substantially adjacent to the card space 149, into which a card 19 is dropped from the card rest 111.

As shown in FIG. 10, the cam lobe element 344 is in a card-retaining or card-receiving position, in which a card 19 is retained within the card space 149. More specifically, it is seen from a study of FIG. 10 that the cam lobe element 344 has a wider portion and a narrower portion because of its elliptical cross-sectional shape. It is also seen that when in the card-retaining position as shown, the cam lobe element 344 is rotationally oriented so that the narrower portion of the cam lobe element 344 is substantially adjacent to the card space 149. Thus, rotation of the cam lobe element 344 for approximately one-quarter of a turn can cause the wider portion of the cam lobe element 344 to move into adjacency with the card space 149. Rotation of the cam lobe elements 344 approximately one-quarter of a turn will preferably cause release of the retained card 19 from the card space 149. More specifically, rotation of the cam lobe element 344 will preferably cause the retained card 19 to be pushed from its retained position in the card space 149, and to fall into the card collector 161.

Figure 17:
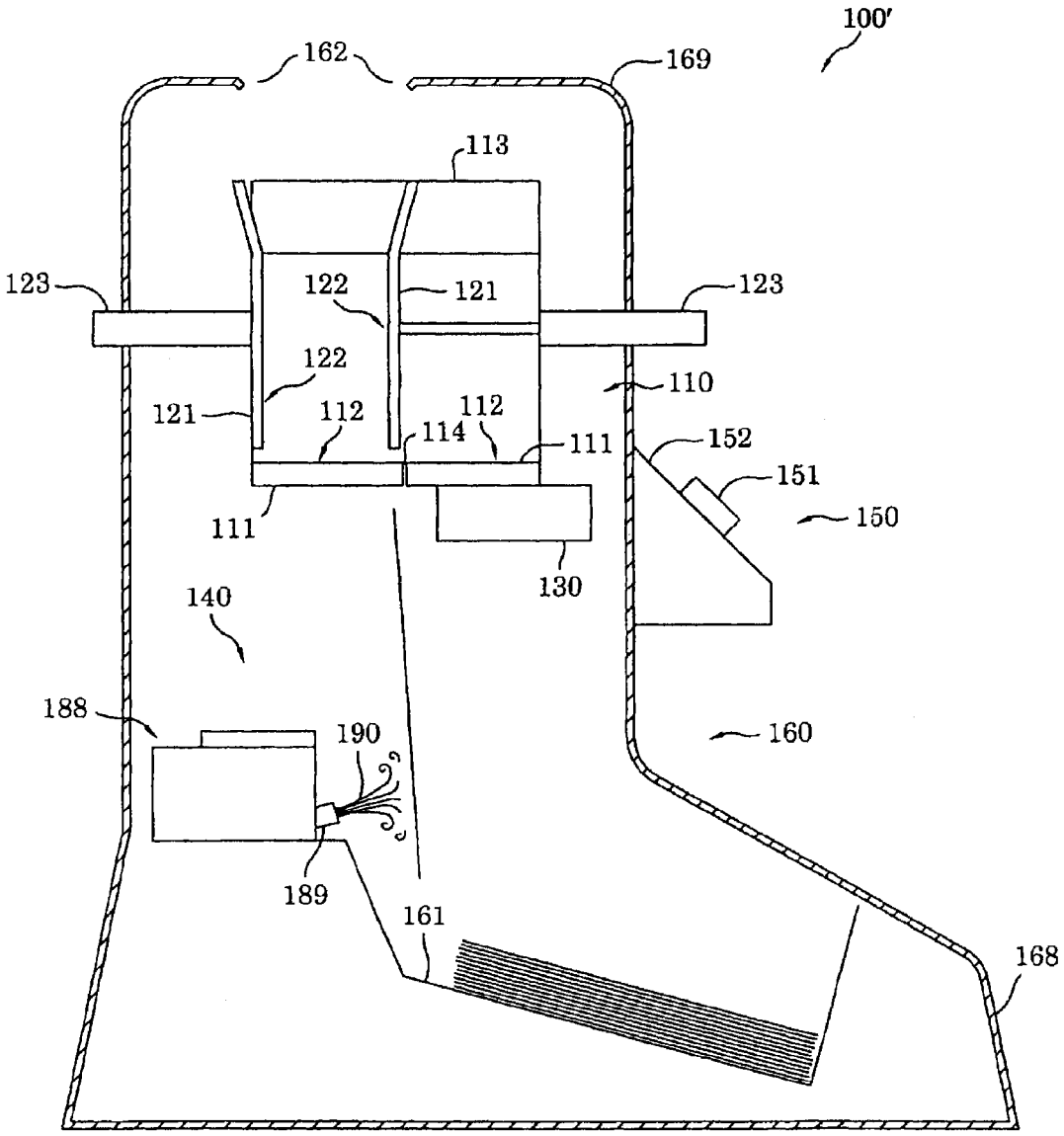
FIG. 17 is a diagrammatic elevational view of a still further version of the invention.

FIG. 17 shows a further alternative embodiment of a shuffler 100' similar to card shuffler apparatus 100 in almost all respects. However, the shuffler 100' of FIG. 17 uses a jet pulser 188 with a nozzle 189 that emits a jet or jets of air, or other suitable gas 190. In operation, a dropping card is not stopped in the medial card receiver 140, but is directed by the jet or jets of gas so as to come to rest in the card collector 161.

Figure 18:
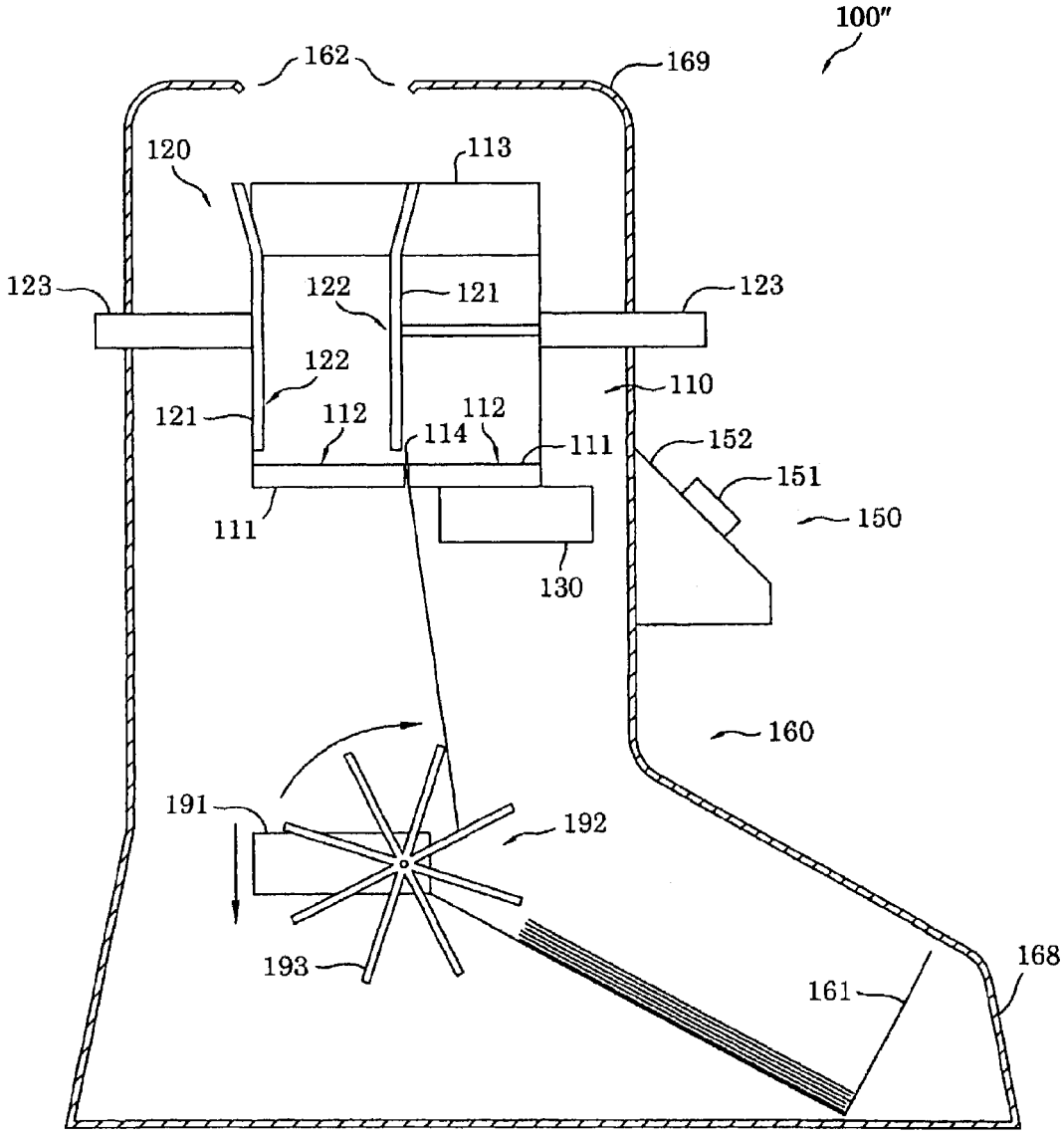
FIG. 18 is a diagrammatic elevational view of another version of the invention.

FIG. 18 shows a shuffler 100" similar to card shuffler apparatus 100 that has another medial guide configuration having a support piece 191, which is connected or mounted upon the frame or housing 160 as is convenient. A guide wheel 192 has vanes 193 and performs by directing and reorienting the dropping cards onto a stack being formed in the card collector 161.

Methods and Manners of Use

With reference to FIG. 1, a method of shuffling a plurality of playing cards 10 includes supporting the cards on an intake support surface 112. The method can include supporting the cards on a surface having at least one card aperture 114. The cards can be supported in a suitable orientation, for example, the cards can be supported substantially on-edge, and preferably upstanding.

Vibratory action is imparted to the cards. The vibratory action can be produced, for example, by an exciter 130, which is described hereinabove with respect to the card shuffler apparatus 100. The method also includes allowing one or more cards to drop into a medial zone advantageously provided with a card receiver 140. For example, one or more of the cards can be allowed to drop through the at least one card aperture 114 in response to imparting the vibratory action to the cards.

In some methods, at least one of the dropped cards is retained within the card receiver 140 in response to allowing the at least one card to drop. Retaining at least one of the cards includes retaining at least one of the cards so that the retained card substantially blocks the card receiver 140 and/or the card aperture 114. The method includes repositioning the supported cards relative to the card receiver 140. Repositioning the cards preferably includes moving the supported cards to a randomly selected position relative to the card receiver 140. The method includes releasing the retained card from the card receiver 140 in response to repositioning the supported cards. Repositioning of the supported cards can be accomplished substantially by the positioner or repositioner 120.

The method can include detecting that at least one card is being retained in the card receiver 140. For example, this can include detecting that at least one card has been fully received into a retained position within the card receiver 140. The process of detecting can be accomplished substantially by way of the card sensor 146, for example. Repositioning of the supported cards 10 can be performed in response to detecting that at least one card is retained. Retaining the at least one card preferably includes holding the retained card in a position wherein an upper edge of the card is substantially flush or even with the support surface 112.

The method can include allowing a plurality of supported cards to sequentially drop into the card receiver 140 according to a random sequence. The method can also include sequentially retaining each of the dropped cards according to the random sequence. The supported cards can be repositioned during retention of each of the plurality of cards. The method can include sequentially releasing each of the retained cards according to the random sequence.

The method can include collecting cards that are released through the card aperture 114. The process of collecting the cards can be accomplished by a card collector 161, which is described hereinabove with respect to the card shuffler apparatus 100. The method can include forming a stack of the collected cards. The stack can be formed by the card collector 161, according to at least one embodiment of the inventions. According to the method, the process of allowing the cards 10 to be released through the card aperture 114 includes allowing the cards 10 to drop through the card aperture 114.

The process of allowing the cards 10 to be released through the card aperture 114 can include substantially blocking and/or unblocking the card aperture 114, according to some preferred method.

Blocking and/or unblocking the card aperture 114 can also be accomplished, for example, by a gate system, which can include employing movable gates 567 to block and unblock the card aperture 114. The method can further include sensing whether the card aperture 114 is blocked or unblocked. Selective control of whether the card aperture 114 is blocked or unblocked can be accomplished, at least in part, by a controller 150 and an optional aperture actuator 119, which are described hereinabove with respect to the card shuffler apparatus 100.

According to at least one embodiment of the inventions, the card shuffler apparatus 100 depicted in FIG. 1 can be used in the following manner A plurality of cards 10 is selected and is placed onto the card rest 111. For example, the plurality of cards 10 can be substantially in the form of one or more decks of cards. Preferably, the cards 10 are placed onto the card support 110, so as to be substantially supported on the support surface 112. The cards 10 can be supported by the card rest 111 in one or more of a variety of possible orientations, wherein the cards 10 are supported on the support surface 112 substantially on-edge. For example, the cards 10 can be supported in a substantially upright or upstanding orientation, which includes, but is not limited to, a substantially vertical orientation.

The card shuffler apparatus 100 can be turned on or otherwise activated so as to be in an operational mode. An operational mode of the card shuffler apparatus 100 preferably includes imparting vibratory action to the cards 10. Imparting vibratory action to the cards 10 can include, but is not limited to, imparting vibratory action to the card rest 111. According to a preferred embodiment of the inventions, vibratory action is provided by the exciter 130. More preferably, the exciter 130 is adapted to impart vibratory action to the cards 10 supported on the card rest 111. Additionally, or alternatively, the exciter 130 is adapted to impart vibratory action to the card rest 111.

Preferably, vibratory action imparted to the cards 10 supported on the card rest 11 results in an appearance of the cards "dancing" or "floating" on the card rest 111. For example, vibratory action imparted to the cards 10 preferably results in the cards 10 bouncing substantially upward and downward while being substantially contained above the card rest 111. According to at least one embodiment of the inventions, vibratory action imparted to the cards 10 causes the cards to bounce on the card rest 111, which in turn, results in one or more of the cards falling or dropping through one or more of the card apertures 114 (only one card aperture 114 is depicted). The card aperture 114 can be controlled by a gate system according to at least one embodiment of the inventions. The gate system is preferably adapted to selectively block and/or unblock one or more of the card apertures 114. Such a gate system can include means of employing at least one playing card to block the card aperture 114 and/or to block the card receiver 140.

As cards 10 fall through the card aperture 114, the cards 10 supported on the card rest 111 decrease in number. To compensate for the decreasing number of cards 10 supported on the card rest 111, the positioner 120 can be employed to maintain the cards 10 substantially on-edge while also supported on the card rest 111. For example, the positioner 120 can include one or more face guides 121 that are adapted to move inward toward the cards 10 as the number of cards supported on the card rest 111 decreases. In this manner, the positioner 120 can function to maintain the cards 10 substantially on-edge while being supported on the card rest 111.

The cards 10 can be collected after they are released through the card aperture 114, as described hereinabove. Collection of the cards after being released through the card aperture 114 can be accomplished by a card collector 161, which is described hereinabove with respect to the card shuffler apparatus 100. Operation of the card shuffler apparatus 100 is preferably continued until a desired quantity of cards is either released from the card rest 111 or collected and/or stacked by the card collector 161. Shuffled cards 10 can be retrieved from the card collector 161. In accordance with at least one embodiment of the inventions, a plurality of cards 10 can be fed or processed through the card shuffler apparatus 100 more than once to increase the degree of shuffling.

The apparatuses described herein are intended for use with playing cards. In particular, the apparatuses are especially appropriate for use with plastic playing cards.

Manner and Materials of Making

The apparatuses according to this invention may be made using a variety of fabrication and molding techniques. The support actuations are advantageously stepper motors with a coded output for precise control.

Other parts can be made of metal or plastics of a variety of types now known or hereafter developed.

The components that touch the cards are advantageously made from TEFLON® or other polymer materials that prevent or reduce wear on cards. Also, suitably coated components that have low-friction surfaces of various types may be appropriate.

What is claimed is:

1. A card shuffler apparatus, comprising:

a horizontal card support surface configured to receive cards;

a positioner configured to move a group of cards oriented substantially perpendicular to the card support surface in a first direction and a second opposite direction, the first and second directions substantially parallel to the card support surface, the positioner configured to move to a plurality of positions relative to the card support surface; and a card receiver configured to receive a single card from the card support surface after the positioner moves the group of cards to a position of the plurality of positions relative to the card support surface.

2. The card shuffler apparatus of claim 1, wherein the card shuffler apparatus is configured to individually release cards from the card support surface in a randomized order and to sequentially pass the released cards into the card receiver in the randomized order.

3. The card shuffler apparatus of claim 1, wherein the card support surface is configured to support cards in a substantially upstanding on-edge orientation.

4. The card shuffler apparatus of claim 1, wherein the card support surface defines a card aperture extending through the card support surface.

5. The card shuffler apparatus of claim 4, wherein the card aperture is adapted to allow passage therethrough of only one card at a time.

6. The card shuffler apparatus of claim 5, wherein the positioner is adapted to randomly reposition cards relative to the card aperture.

7. The card shuffler apparatus of claim 1, further comprising an exciter configured to impart vibration to the cards over the card support surface.

8. The card shuffler apparatus of claim 1, further comprising a gate configured to move relative to the card support surface between a first position and a second position, wherein cards supported on the card support surface are prevented from moving to the card receiver by the gate when the gate is in the first position, and wherein a card supported on the card support surface is allowed to move to the card receiver when the gate is in the second position.

9. The card shuffler apparatus of claim 8, further comprising an actuator configured to move the gate between the first position and the second position.

10. The card shuffler apparatus of claim 1, wherein the card support surface at least partially defines a receptacle configured to receive cards from a user of the card shuffler apparatus.

11. A method of shuffling cards, comprising:

moving a first plurality of cards in a first direction substantially parallel to a card support surface to a first position relative to the card support surface, the card support surface having an aperture therethrough;

transferring a first card through the aperture in the card support surface to a card receiver to leave a second plurality of cards less than the first plurality of cards on the card support surface;

moving the second plurality of cards in a second direction opposite the first direction to a second position relative to the card support surface; and transferring a second card through the aperture in the card support surface to the card receiver.

12. The method of claim 11, wherein transferring a first card through the aperture in the card support surface comprises transferring only one card through the aperture in the card support surface, and wherein transferring a second card through the aperture in the card support surface comprises transferring only one card through the aperture in the card support surface.

13. The method of claim 11, wherein moving a first plurality of cards in a first direction substantially parallel to a card support surface to a first position relative to the card support surface comprises moving the first plurality of cards to a first random position relative to the card support surface, and wherein moving the second plurality of cards in a second direction opposite the first direction to a second position relative to a card support surface comprises moving the second plurality of cards to a second random position relative to the card support surface.

14. The method of claim 11, further comprising collecting cards played in a playing card game and placing the cards played in the playing card game over the card support surface to form the first plurality of cards.

15. The method of claim 11, further comprising removing cards from the card receiver and using the cards removed from the card receiver in a playing card game.

16. The method of claim 11, further comprising supporting the first plurality of cards and the second plurality of cards in an upstanding on-edge orientation over the card support surface.

17. The method of claim 11, further comprising vibrating the first plurality of cards and the second plurality of cards.

18. The method of claim 17, wherein vibrating the first plurality of cards and the second plurality of cards comprises vibrating the first plurality of cards and the second plurality of cards at a frequency in a range from about 10 Hz to about 100,000 Hz.

19. A card shuffler apparatus, comprising:

a receptacle in which a user of the card shuffler apparatus may place a plurality of cards in a substantially vertical orientation;

a positioning mechanism configured to randomly reposition the plurality of cards horizontally in two opposite directions in the receptacle;

a transfer mechanism configured to individually release cards responsive to gravity from the receptacle in a randomized order; and a card collector for receiving cards individually released from the receptacle and from which the received cards may be removed from the card shuffler apparatus by the user of the card shuffler apparatus.

20. The card shuffler apparatus of claim 19, further comprising an exciter configured to cause the plurality of cards in the receptacle to vibrate.

* * * * *

UNITED STATES PATENT AND TRADEMARK OFFICE

CERTIFICATE OF CORRECTION

PATENT NO. : 9,233,298 B2
APPLICATION NO. : 14/275719
DATED : January 12, 2016
INVENTOR(S) : Randy D. Sines It is certified that error appears in the above-identified patent and that said Letters Patent is hereby corrected as shown below:

On the title page:

In ITEM (57) ABSTRACT:

| | |
|---|---|
| LINE 1, | change "apparatus is for" to --apparatus for-- |
| LINE 2, | change "gaming. The apparatus includes" to --gaming includes-- |
| LINE 3, | change "support the unshuffled" to --support unshuffled-- |
| LINE 8, | change "of the apparatuses," to --apparatus,-- |
| LINE 13, | change "slots though which" to --slots through which-- |

In the specification:

| | | |
|---|---|---|
| COLUMN 17, | LINE 29, | change "(FIG. 1) Impartation" to --(FIG. 1). Impartation-- |
| COLUMN 21, | LINE 54, | change "manner A plurality" to --manner. A plurality-- |
| COLUMN 22, | LINE 12, | change "rest **11** results" to --rest **111** results-- |

Signed and Sealed this
Third Day of May, 2016

Michelle K. Lee

Michelle K. Lee
*Director of the United States Patent and Trademark Office*